US007815272B2

(12) United States Patent
Kasai et al.

(10) Patent No.: US 7,815,272 B2
(45) Date of Patent: Oct. 19, 2010

(54) ELEMENT BODY FOR RECORDING HEAD AND RECORDING HEAD HAVING ELEMENT BODY

(75) Inventors: Ryo Kasai, Tokyo (JP); Tatsuo Furukawa, Kanagawa (JP); Masataka Sakurai, Kanagawa (JP); Nobuyuki Hirayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1098 days.

(21) Appl. No.: 11/449,702

(22) Filed: Jun. 9, 2006

(65) Prior Publication Data

US 2006/0284909 A1 Dec. 21, 2006

(30) Foreign Application Priority Data

Jun. 16, 2005 (JP) ..... 2005-176890

(51) Int. Cl.
*B41J 29/38* (2006.01)

(52) U.S. Cl. ..... 347/12; 347/9; 347/57; 347/58; 347/59

(58) Field of Classification Search ..... 347/9, 347/12, 57–59
See application file for complete search history.

(56) References Cited

U.S. PATENT DOCUMENTS

| | | | | |
|---|---|---|---|---|
| 6,054,689 | A | 4/2000 | Imanaka et al. | 219/501 |
| 6,116,714 | A | 9/2000 | Imanaka et al. | 347/19 |
| 6,290,334 | B1 | 9/2001 | Ishinaga et al. | |
| 6,302,504 | B1 * | 10/2001 | Imanaka et al. | 347/9 |
| 6,409,300 | B2 | 6/2002 | Imanaka et al. | 347/19 |
| 6,474,782 | B1 | 11/2002 | Furukawa | |
| 6,523,922 | B2 | 2/2003 | Hirayama | 347/9 |
| 6,712,437 | B2 | 3/2004 | Furukawa et al. | 347/5 |
| 6,945,622 | B2 | 9/2005 | Sakurai | 347/5 |
| 7,133,153 | B2 | 11/2006 | Furukawa | 358/1.4 |
| 2002/0036781 | A1 | 3/2002 | Hirayama | 358/1.4 |
| 2005/0052499 | A1 | 3/2005 | Oomura | |
| 2005/0140707 | A1 | 6/2005 | Imanaka et al. | 347/9 |
| 2005/0206685 | A1 | 9/2005 | Hirayama | |
| 2007/0002340 | A1 | 1/2007 | Furukawa | 358/1.4 |
| 2007/0076031 | A1 | 4/2007 | Hirayama | 347/12 |

FOREIGN PATENT DOCUMENTS

| | | |
|---|---|---|
| EP | 0 816 082 | 1/1998 |
| JP | 5-185594 | 7/1993 |
| JP | 2001-130002 | 5/2001 |
| JP | 2004-50639 | 2/2004 |
| JP | 2004-181679 | 7/2004 |
| WO | WO 2004/110764 | 12/2004 |

* cited by examiner

*Primary Examiner*—Matthew Luu
*Assistant Examiner*—Henok Legesse
(74) *Attorney, Agent, or Firm*—Fitzpatrick, Cella, Harper & Scinto

(57) ABSTRACT

A stable voltage can be supplied from a voltage converter circuit and an increase in the area of the entire element body can be suppressed even if the number of recording elements increases and the element body becomes longer. An element body for a recording head includes a plurality of arrayed recording elements, and a voltage converter circuit which converts an externally input voltage. The voltage converter circuit includes a reference voltage generating section and a voltage converter section, and the voltage converter section is formed from a plurality of distributedly arranged voltage converter elements.

18 Claims, 18 Drawing Sheets

ELEMENT BODY FOR RECORDING HEAD AND RECORDING HEAD HAVING ELEMENT BODY

FIELD OF THE INVENTION

The present invention relates to an element body for a recording head and a recording head having the element body and, more particularly, to the layout of an element body for a recording head on which a plurality of recording elements that are arrayed in a predetermined direction and divided into a plurality of groups by a predetermined number of recording elements, and a drive circuit for driving each recording element are arranged on the same element body.

BACKGROUND OF THE INVENTION

A recording apparatus which records information such as a desired character or image on a sheet-like recording medium such as paper or a film is known as an information output apparatus for a wordprocessor, personal computer, facsimile apparatus, and the like. Because of low costs and easy downsizing, such recording apparatuses generally widely employ a serial recording method of recording information during reciprocal scanning in a direction perpendicular to the feed direction of a recording medium such as paper.

The structure of a recording head used in the recording apparatus will be explained by exemplifying a recording head complying with an inkjet recording method of recording information using thermal energy. In the inkjet recording head, a heat element (heater) is arranged as a recording element at a portion communicating with a discharge aperture (nozzle) for discharging ink droplets. A current is supplied to the heat element to generate heat, bubble ink, discharge ink droplets, and thereby record information. This recording head makes it easy to arrange many discharge apertures and heat elements. (heaters) at high densities, and can obtain a high-resolution recorded image.

The heat elements (heater) of the recording head and their drive circuit according to a conventional inkjet recording method are formed on the same element body using a semiconductor process technique (patent reference 1).

FIG. 1 shows an example of the circuit block layout of an element body 100 for a recording-head on which heaters and their drive circuits are integrally formed. FIG. 4 is a block diagram schematically showing circuits arranged on one side of an ink supply aperture on the element body. The same reference numerals as those in FIG. 1 denote the same parts.

An elongated ink supply aperture 101 is formed at almost the center of the element body 100, along the long side (longitudinal direction in FIG. 1) of the element body. Heater arrays 102, driver transistors 103 for driving heaters, booster circuits 105, high-voltage logic circuits 104, and data lines and decoder lines Ill are symmetrically arranged in the order named outward from the center on the two sides of the ink supply aperture 101. Pads 109 for externally supplying power and electrical signals are arranged at two, upper and lower ends of the element body 100 along the short side of the element body. A circuit including a shift register 106 and latch 108 is arranged on the inner side of each pad 109. A decoder 107 is arranged on one side on the inner side of the shift register and latch circuits 106 and 108. A voltage converter circuit 110 for supplying power to the booster circuit 105 is arranged widely along the short side of the element body between the decoder 107 and a portion at which elements up to the logic circuits 104 are arranged from the ink supply aperture 101.

In the layout shown in FIG. 1, the pad 109 corresponding to the heater array 102, driver transistor 103, booster circuit 105, and logic circuit 104 on the right side of the ink supply aperture 101 is arranged on the upper side. The shift register 106, latch 108, decoder 107, and voltage converter circuit 110 corresponding to the above-mentioned elements on the right side of the ink supply aperture 101 are also arranged on the upper side. The pad 109 corresponding to the heater array 102, driver transistor 103, booster circuit 105, and logic circuit 104 on the left side of the ink supply aperture 101 is arranged on the lower side. The shift register 106, latch 108, decoder 107, and voltage converter circuit 110 corresponding to the above-mentioned elements on the left side of the ink supply aperture 101 are also arranged on the lower side.

The heater array 102 in the prior art is divided into M groups, as shown in FIG. 4. Each signal is input to the circuit of FIG. 4 at a timing as shown in FIG. 3. A data signal DATA synchronized with a clock signal CLK is serially input to the shift register in the order of M-bit data which designates a group and X-bit data which designates a heater in the group. When a data signal DATA of predetermined bits is input, the data is held at a timing when a latch signal LT changes to low level. The latter X-bit data of the data signal DATA input to the shift register is decoded into N-bit (X<N) data by the decoder 107. This circuit configuration using the decoder can compress the data amount, reduce the transfer data amount, and drive heaters at a higher speed.

The M-bit and N-bit signals select a driver transistor 103 which is controlled by M×N matrix driving of the logic circuit 104. The logic circuit 104 outputs a signal which drives the selected driver transistor 103 by a specific time (pulse width) in a period during which a heat signal HE is kept low. However, the output voltage of the logic circuit 104 cannot control the driver transistor 103. Thus, the output voltage is boosted to a predetermined voltage by the booster circuit 105 to drive the driver transistor 103 and thereby energize and drive the heater array 102. N driver transistors 103 and N heaters in the heater array 102 of one group are driven by time division. The numbers of simultaneously driven driver transistors 103 and heaters in the heater array 102 are one per group and M at maximum in all the groups. That is, all heaters can be driven by selecting M driver transistors 103 and M heaters in the heater array 102 N times by time division.

In the prior art, powers externally input from the pad 109 are a power source voltage VDD (about 3 V) for driving a logic circuit, and VSS which is the corresponding ground voltage GND. Powers also include a heater voltage VH (about 24 V) for driving a heater, GNDH which is corresponding ground voltage GND, and power VHT having the same voltage value as the heater voltage VH. The power VHT is input to the voltage converter circuit 110, and converted into a converted voltage VHTM used as power for the driver transistor 103, high-voltage logic circuit 104, and booster circuit 105. The voltage value of the converted voltage VHTM is large enough to drive the driver transistor 103, and is larger than the power source voltage VDD and smaller than the breakdown voltages of elements which form the driver transistor 103 and booster circuit 105. In the prior art, the voltage value of the converted voltage VHTM is about 14 V. By arranging the voltage converter circuit 110, the number of power source wirings for externally supplying power can be minimized to reduce costs.

FIG. 2 shows the circuit configuration of the voltage converter circuit 110 in the prior art. As shown in FIG. 2, the voltage converter circuit 110 has a source-follower configuration. A predetermined reference voltage is applied to the gate of a MOSFET 201 to define the voltage value of the converted voltage (VHTM). If a predetermined voltage is always applied to the gate of the MOSFET 201, fluctuations in converted voltage are suppressed even upon a change in current value flowing through the drain-source path of the MOSFET 201. In order to always keep the converted voltage constant, a predetermined voltage must always be applied to the gate of the MOSFET 201.

For this purpose, a reference voltage generating section 202 in this example generates a predetermined reference voltage by dividing resistors. A desirable example of the resistive element is an element (e.g., a poly-Si (polysilicon) element) which hardly varies in resistance value upon variations in heat and applied voltage. To the contrary, a source load resistance 203 less influences voltage fluctuations of the converted voltage VHTM than the reference voltage generating section 202, so an element (e.g., a diffusion resistance) of a small layout area is desirably used.

[Patent Reference 1] Japanese Patent Laid-Open No. 5-185594

As described above, the converted voltage VHTM is applied to the driver transistor 103, logic circuit 104, and booster circuit 105. The converted voltage VHTM has a voltage value which is generated (converted) in the voltage converter circuit 110. The converted voltage VHTM is more unstable and more readily fluctuates than externally supplied power such as the heater voltage VH or power source voltage VDD.

If the converted voltage VHTM becomes unstable, for example, if the converted voltage VHTM greatly drops, the driver transistor 103 cannot be driven. Further, the logic circuit 104 and booster circuit 105 may not be driven or malfunction.

As is apparent from the element body layout shown in FIG. 1, the voltage converter circuit 110 which applies the converted voltage VHTM is arranged on one side of a corresponding driver transistor 103, logic circuit 104, and booster circuit 105. A voltage applied to a circuit spaced apart from the voltage converter circuit 110 is more prone to drop or become unstable under the influence of the wiring resistance or the like, than a voltage applied to a circuit near the voltage converter circuit 110.

Along with recent increases in the speed of inkjet recording apparatuses, the element body of the recording head tends to be longer in order to increase the number of nozzles. The longer element body requires longer wiring for the converted voltage VHTM, and the above-described problems worsen. Since the number of simultaneously driven elements increases for higher speeds, the converted voltage VHTM must be more stable.

In order to stabilize the converted voltage VHTM, the voltage converter circuit 110 is effectively enlarged. More specifically, the MOSFET 201 is generally enlarged to supply a larger current. This, however, increases the element body area and cost.

SUMMARY OF THE INVENTION

The present invention has been made in consideration of the above situation, and has as its object to supply a stable voltage from a voltage converter circuit and suppress an increase in the area of the entire element body even if the number of recording elements increases and the element body becomes longer.

In order to achieve the above object, according to one aspect of the present invention, an element body for a recording head comprises a plurality of arrayed recording elements, and a voltage converter circuit which converts an externally input voltage, the voltage converter circuit including a reference voltage generating section and a voltage converter section, and the voltage converter section being formed from a plurality of distributedly arranged voltage converter elements.

This arrangement shortens the wiring length from each of distributed voltage converter elements to the booster circuit. Since the influence of the wiring resistance or the like is reduced, a stable interlevel voltage can be applied.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Figure 1:
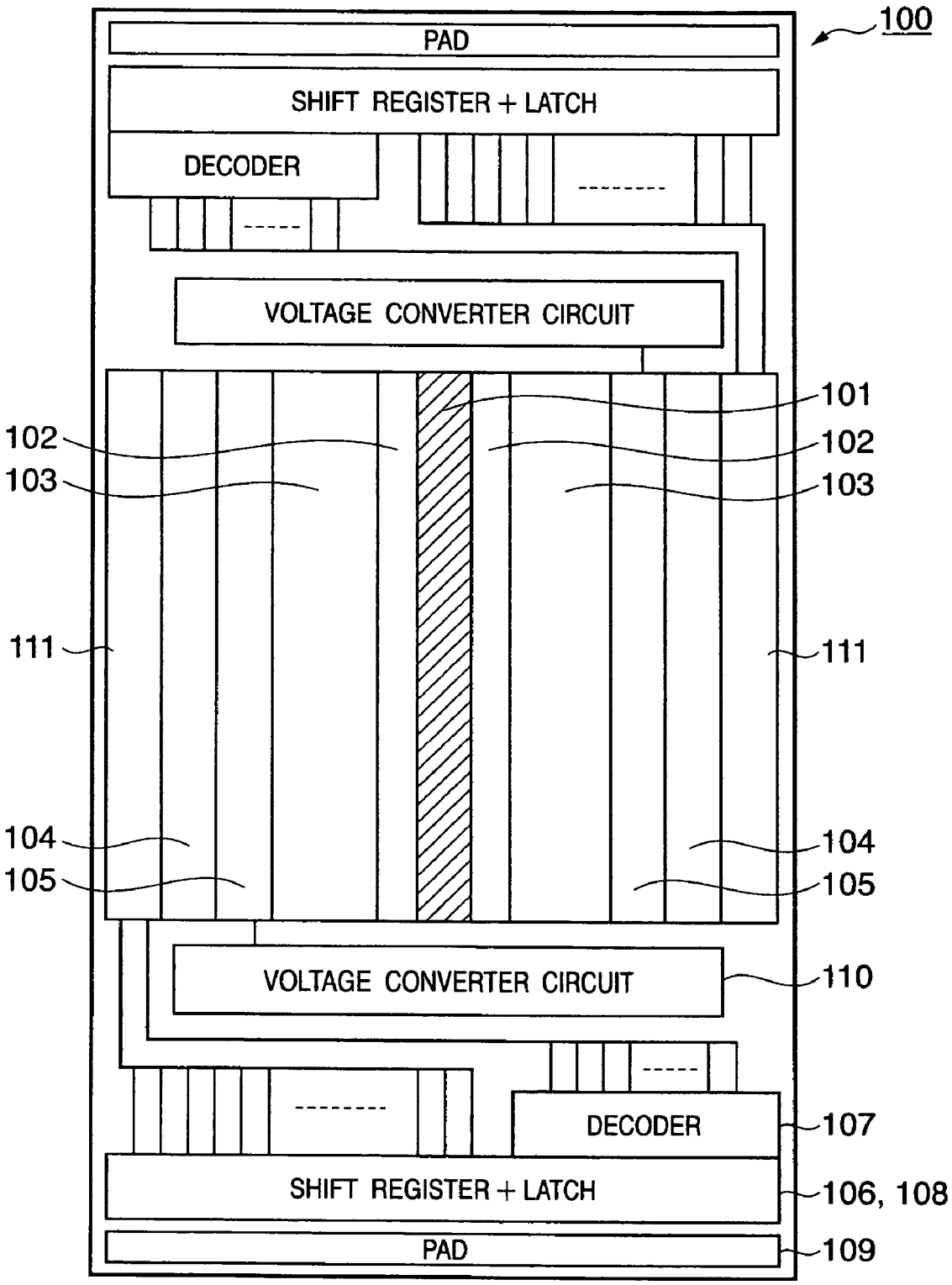
FIG. 1 is a view showing an example of the circuit block layout of a conventional element body.

Preferred embodiments of the present invention will be illustratively described in detail below with reference to the accompanying drawings. Building elements described in the following embodiments are merely an example, and the scope of the present invention is not limited to them.

In this specification, the term "element body" means not only a body formed from a silicon semiconductor but also a body having elements, circuits, wirings, and the like. Note that the body may be shaped into a plate or chip.

The expression "on the element body" means not only "simply on the element body" but also the surface of the element body and the inside of the element body near the surface. "Integration" in the present invention means not only to simply arrange separate elements on the element body but also to integrally form and manufacture elements on the element body by the semiconductor circuit manufacturing process or the like.

The voltage converter circuit in the embodiments includes a reference voltage generating section and voltage converter section, and the voltage converter section is made up of a plurality of distributedly arranged voltage converter elements. The reference voltage of the reference voltage generating section is a voltage serving as a reference for a converted voltage (VHTM).

Even when the number of recording elements increases, the area where voltage converter elements are arranged becomes larger as the length in a direction in which recording elements are arrayed increases. It becomes easy to cope with the increase in the number of recording elements and elongation of the element body.

Even if the number of recording elements increases and the element body becomes longer a stable voltage can be applied from the voltage converter circuit, and an increase in the area of the entire element body can be suppressed.

The predetermined direction is the longitudinal direction of an elongated ink supply aperture which is formed in the element body in order to supply ink. A recording element, driver transistor, and logic circuit may be arranged in the order named from the ink supply aperture in the predetermined direction.

The reference voltage generating section may extend in a direction perpendicular to the predetermined direction.

One voltage converter element may be arranged in each group of a predetermined number of adjacent recording elements. In each group according to the embodiment, recording elements are not simultaneously driven. In different groups, recording elements in the same block can be substantially simultaneously driven. When the number of driven recording elements in each group is one, the performance of the voltage converter element suffices to cope with one recording element, and size reduction can be achieved. Voltage converter elements arranged in respective groups suffice to be identical between groups, and can be easily formed. As another example, two or three recording elements may also be simultaneously driven in the same group. However, this configuration makes the voltage converter element larger, so the configuration in which only one recording element can be driven in the same group is more desirable.

In this case, the booster circuit may be arranged in correspondence with each recording element, and interposed between the driver transistor and the logic circuit in a predetermined direction. Alternatively, the logic circuit may include a high-voltage logic circuit which is driven by an interlevel voltage, and the booster circuit may be disposed in each group and arranged outside the high-voltage logic circuit in the predetermined direction. A plurality of voltage converter elements may also be distributedly arranged in an area where one of the driver transistor, logic circuit, and booster circuit is arranged, or an area where at least two of the driver transistor, logic circuit, and booster circuit are arranged.

As the voltage converter element, one of a MOSFET, bipolar transistor, and diode can be used. The reference voltage generating section may also include a polysilicon resistive element. Polysilicon has a property of hardly causing variations in resistance value upon variations in heat and applied voltage.

As the recording element, an element including a heat element (heater) for applying thermal energy to ink may also be adopted.

The present invention can also be applied to a recording head which comprises the above-described element body for the recording head and discharges ink, a recording apparatus which performs recording using the recording head, and a recording head cartridge having the recording head and ink cartridge.

According to the present invention, the wiring length from each of distributed voltage converter elements to the booster circuit is shortened. Even when the total size of distributed voltage converter elements is equal to the size in the conventional arrangement, the influence of the wiring resistance or the like is reduced, and a stable interlevel voltage can be applied.

Even when the number of recording elements increases, the area where voltage converter elements are arranged becomes larger as the length in a direction in which recording elements are arrayed increases. It becomes easy to cope with the increase in the number of recording elements and elongation of the element body.

Even if the number of recording elements increases and the element body becomes longer, a stable voltage can be applied from the voltage converter circuit, and an increase in the area of the entire element body can be suppressed.

In the following embodiments, the same reference numerals as those in the prior art denote the same parts, and a detailed description thereof will be omitted.

First Embodiment

Figure 5:
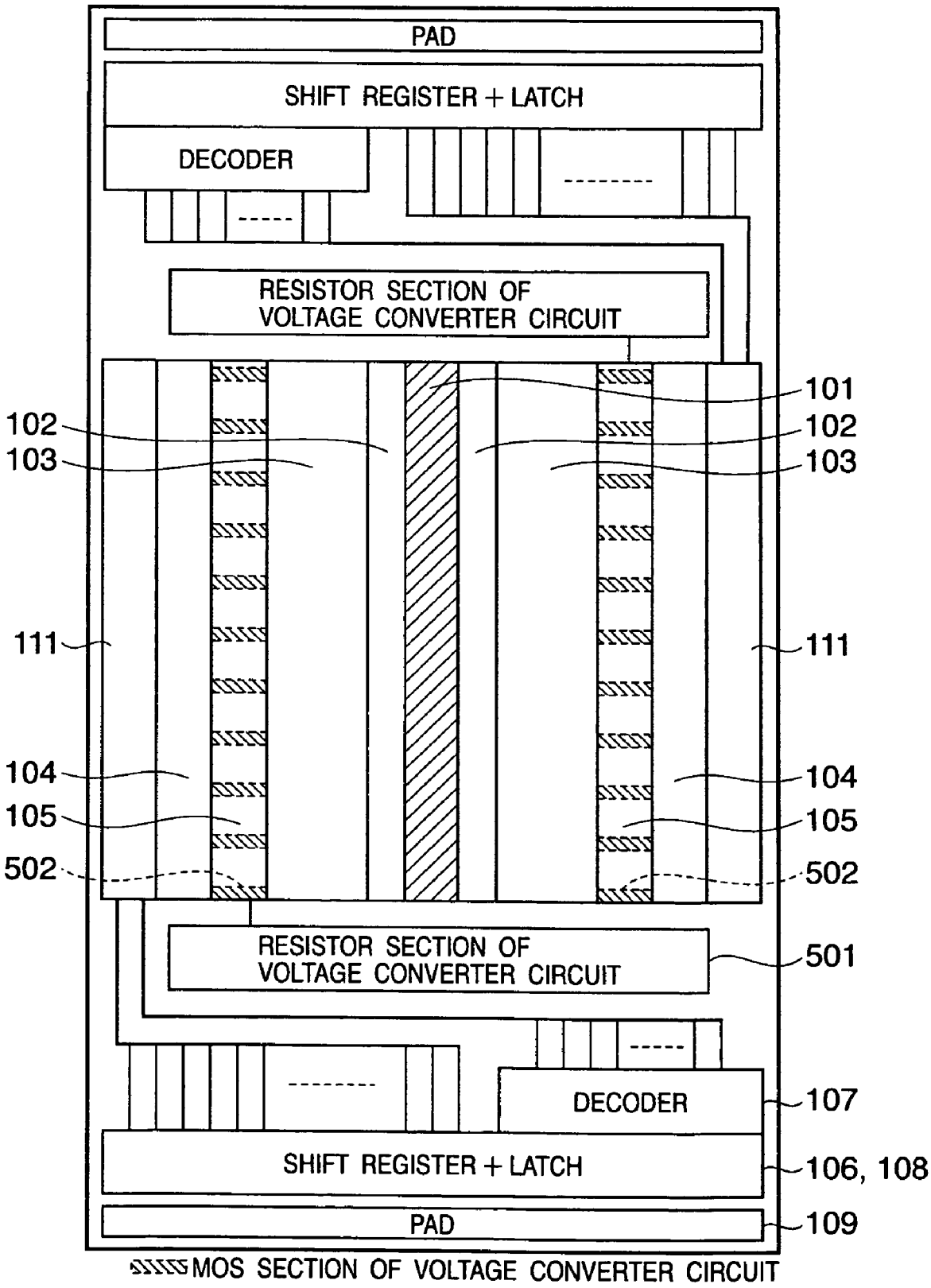
FIG. 5 is a view showing the circuit block layout of an element body according to the first embodiment.
Figure 6:
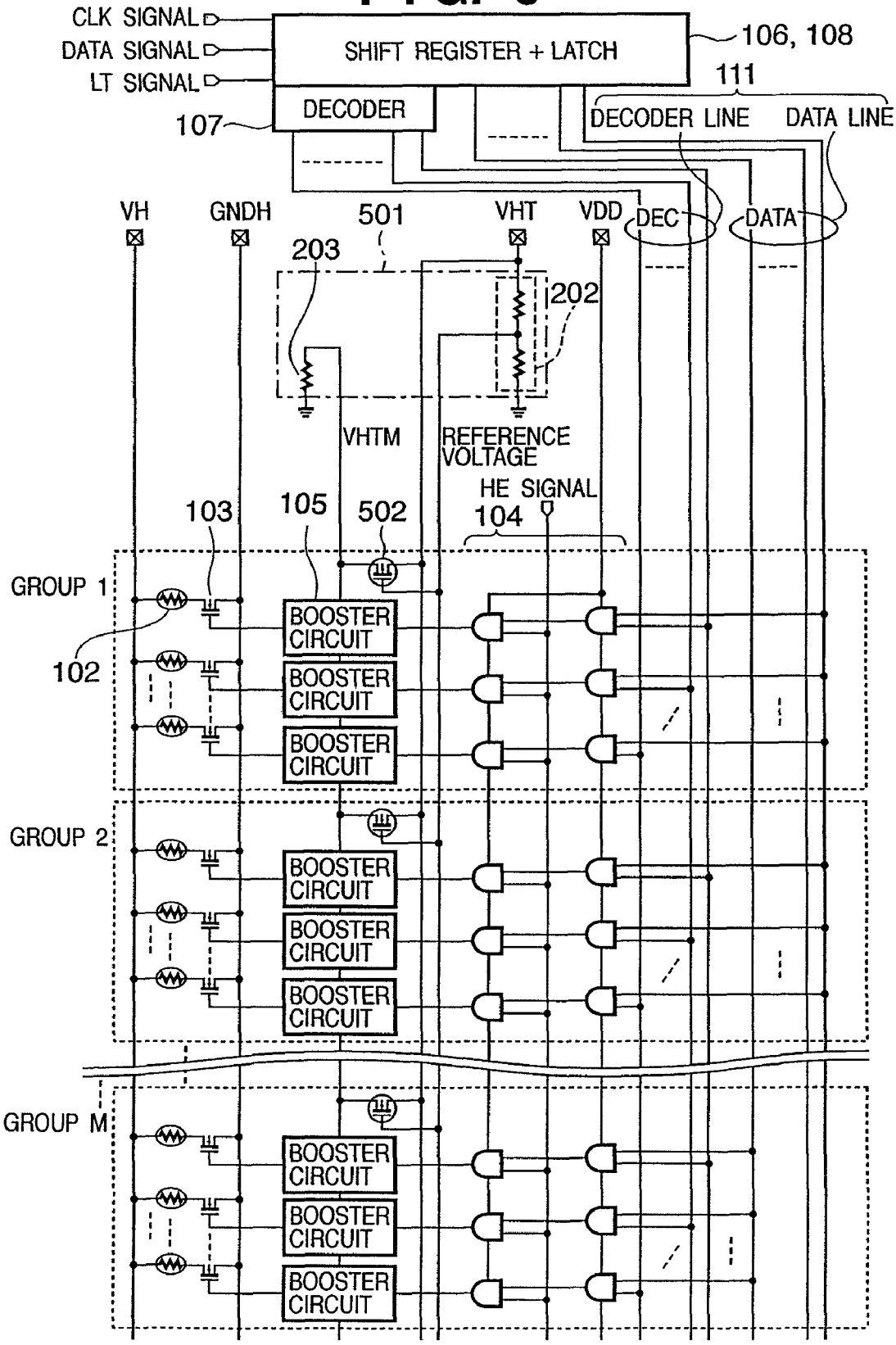
FIG. 6 is a block diagram schematically showing circuits arranged on the element body of FIG. 5.

FIG. 5 is a view showing the layout of circuit blocks on an element body according to the first embodiment of the present invention. FIG. 6 is a circuit diagram showing blocks arranged on one side of an ink supply aperture on the element body of FIG. 5.

The first embodiment will be compared with the prior art described with reference to FIGS. 1 to 4. In the prior art, the voltage converter circuits 110 corresponding to circuit blocks which are symmetrically arranged on the right and left sides of the ink supply aperture 101 are arranged on the upper and lower sides of the ink supply aperture 101. On the contrary, in the first embodiment, the voltage converter circuit is divided into a resistor section and MOSFET section, which are distributedly arranged.

More specifically, the voltage converter circuit is divided into resistor sections 501 which are made up of resistive elements such as the dividing resistor of a reference voltage generating section 202 and a source load resistance 203, and MOSFET sections 502 which are divided in size in correspondence with respective heater groups to reduce one MOSFET size. The resistor section 501 requires a large arrangement area, and it is difficult to divide and arrange the resistor section 501. Further, the merit of arranging the resistor section 501 parallel to a heater array 102 is small. Thus, the resistor section 501 is arranged at the same position as a position where the voltage converter circuit 110 is arranged in FIG. 1. To the contrary, the MOSFET sections 502 are distributedly interposed between booster circuits 105 for respective heater groups.

A reference voltage generated by the dividing resistor of the reference voltage generating section 202 is applied to each group of the heater array 102 together with power VHT input from a pad 109. The reference voltage is input to the gates and drains of the MOSFET sections 502 distributedly interposed between the booster circuits 105. At this time, the converted voltage VHTM is applied, via a corresponding MOSFET section 502 interposed between the booster circuits 105, to the booster circuits 105 which generate power to drive driver transistors 103.

Also in the first embodiment, the three voltages: power source voltage VDD, converted voltage VHTM, and heater voltage VH have the relation of VDD<VHTM<VH, and are about 3 V, 14 V, and 24 V, respectively. The converted voltage VHTM is generated as an interlevel voltage having a potential between the power source voltage VDD of the logic circuit and the heater voltage VH of the heater.

As described-above, the MOSFETs 502 serving as the supply source of the converted voltage VHTM of the voltage converter circuit are distributedly arranged near circuits (booster circuits 105) which actually use the converted voltage VHTM. Even if the total size of the distributed MOSFETs 502 is equal to the size in the conventional arrangement, the influence of the wiring resistance or the like is reduced, and a stable interlevel voltage can be applied by the converted voltage VHTM.

Figure 2:
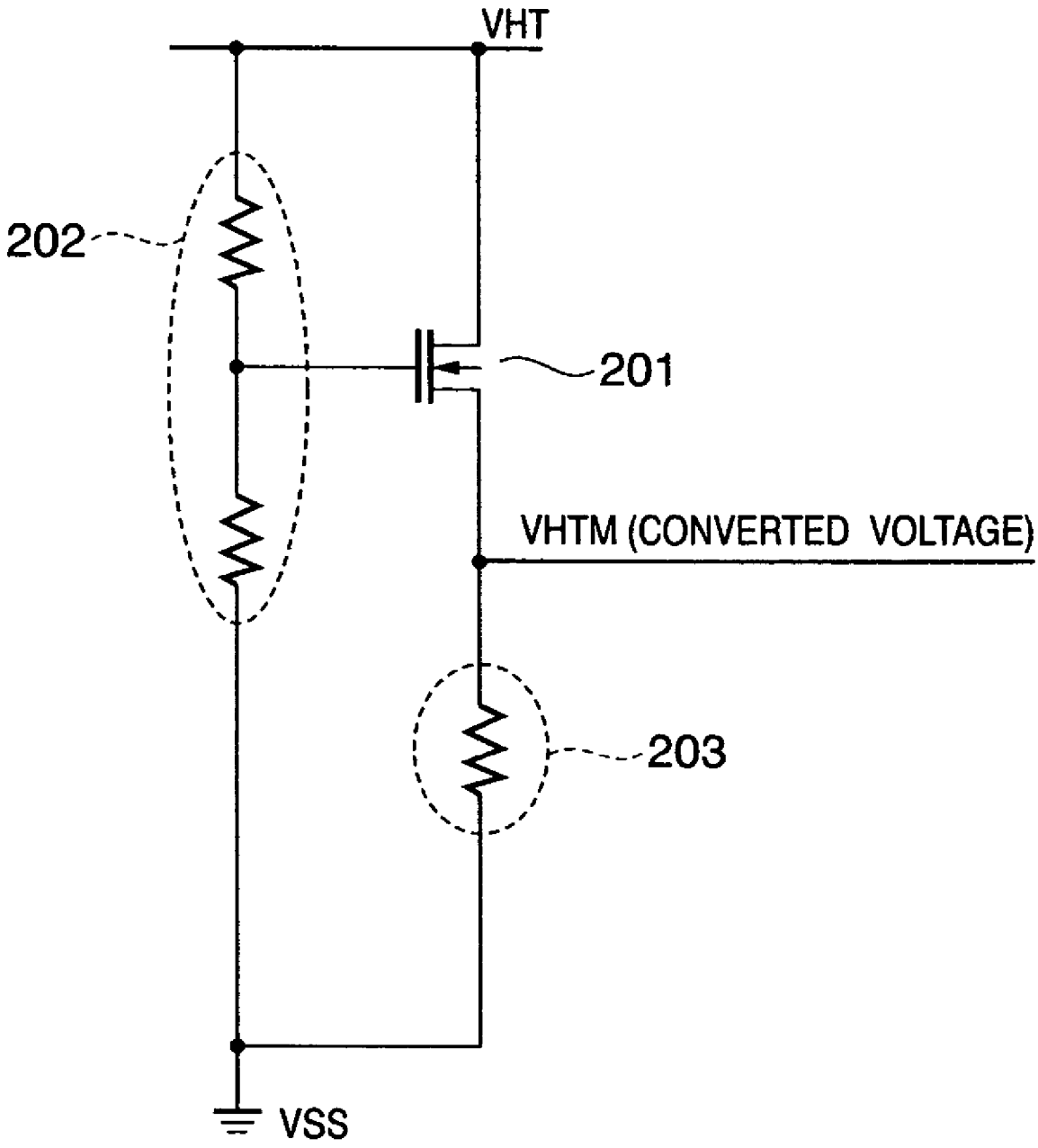
FIG. 2 is a circuit diagram showing a voltage converter circuit.
Figure 3:
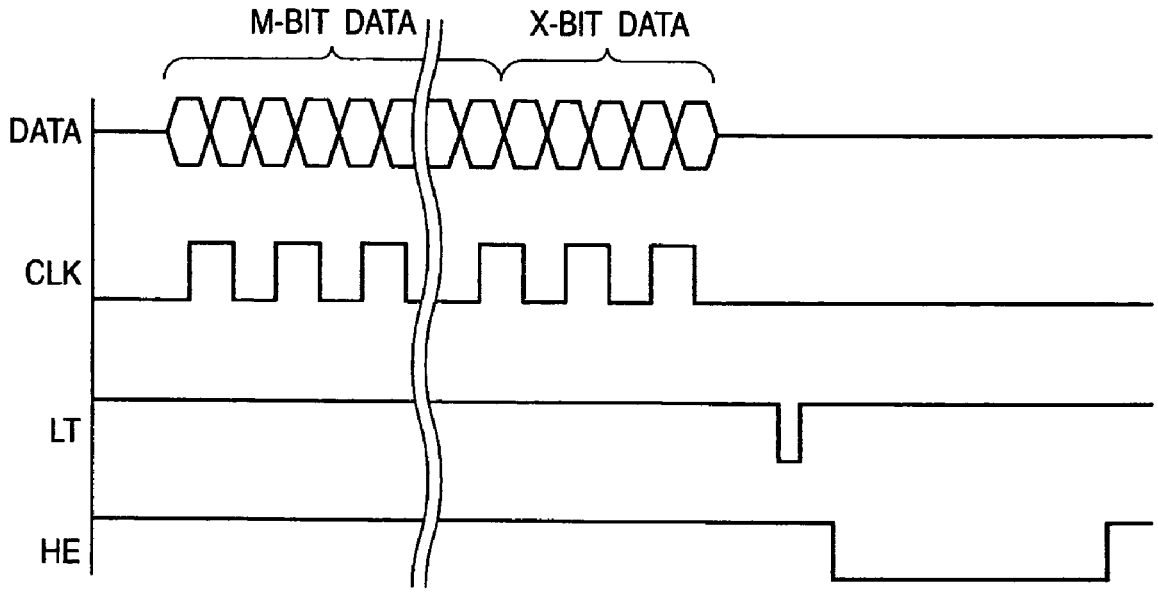
FIG. 3 is a timing chart showing each signal input to the element body.
Figure 4:
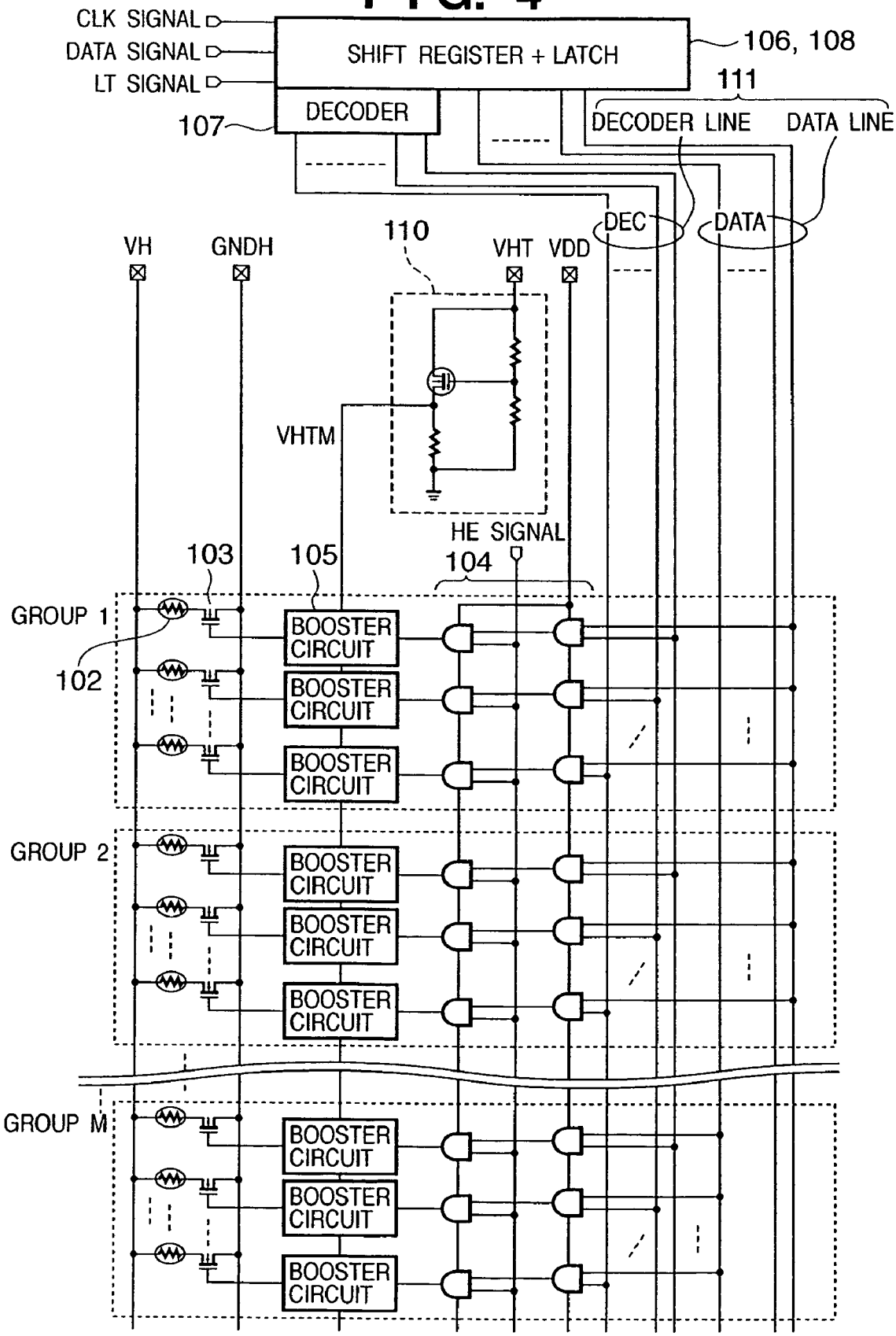
FIG. 4 is a block diagram schematically showing circuits arranged on the element body of FIG. 1.

The basic circuit arrangement of the first embodiment is identical to the conventional configuration as shown in FIG. 2 except the voltage converter circuit, and can be formed by changing only the arrangement of the voltage converter circuit. The design burden is reduced, and the circuit arrangement of the first embodiment can be easily implemented. In the first and subsequent embodiments of the present invention, the voltage converter circuit operates to convert an input voltage into a lower one.

If the number of recording elements is increased and the element body becomes longer, the number of circuits driven by the converted voltage VHTM increases, and the voltage converter circuit must be stabilized more. In the conventional configuration, the MOSFET must be made larger in order to stabilize a voltage output from the voltage converter circuit, and the layout area of the voltage converter circuit must be increased. In contrast, in the configuration of the first embodiment, the MOSFET of the voltage converter circuit is arranged in correspondence with each group. Even if the number of nozzles increases and that of circuits driven by the converted voltage VHTM also increases, the number of groups including MOSFETs is simply increased to easily cope with elongation of the element body.

Note that the first embodiment employs a MOSFET as a voltage converter element. This is because the MOSFET has various advantages: the MOSFET is effective for a digital circuit, the MOSFET requires a smaller area by which the MOSFET occupies the element body than a bipolar transistor or diode and can cope with downsizing of the body, and the manufacturing process is simple.

Second Embodiment

Figure 7:
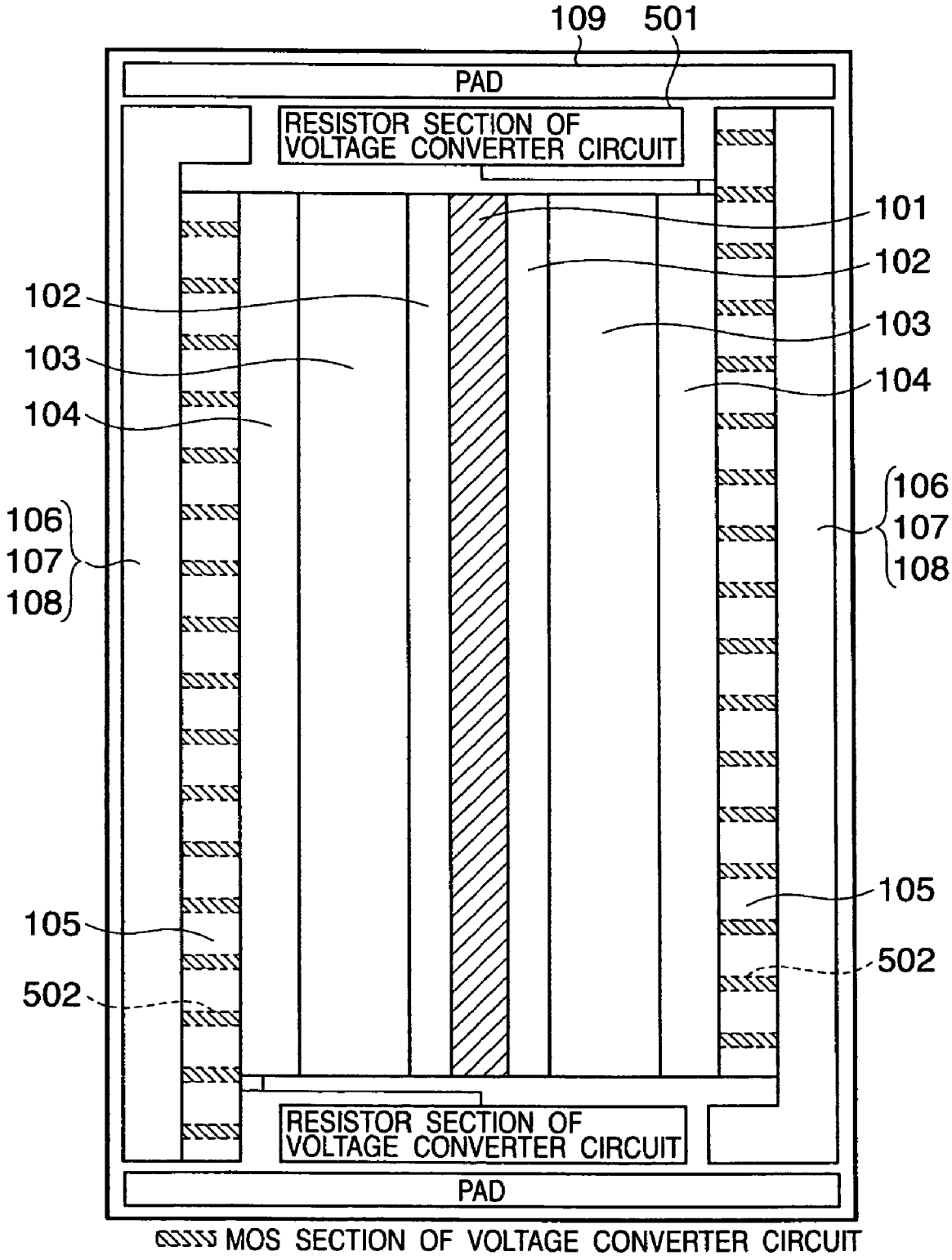
FIG. 7 is a view showing the circuit block layout of an element body according to the second embodiment.
Figure 8:
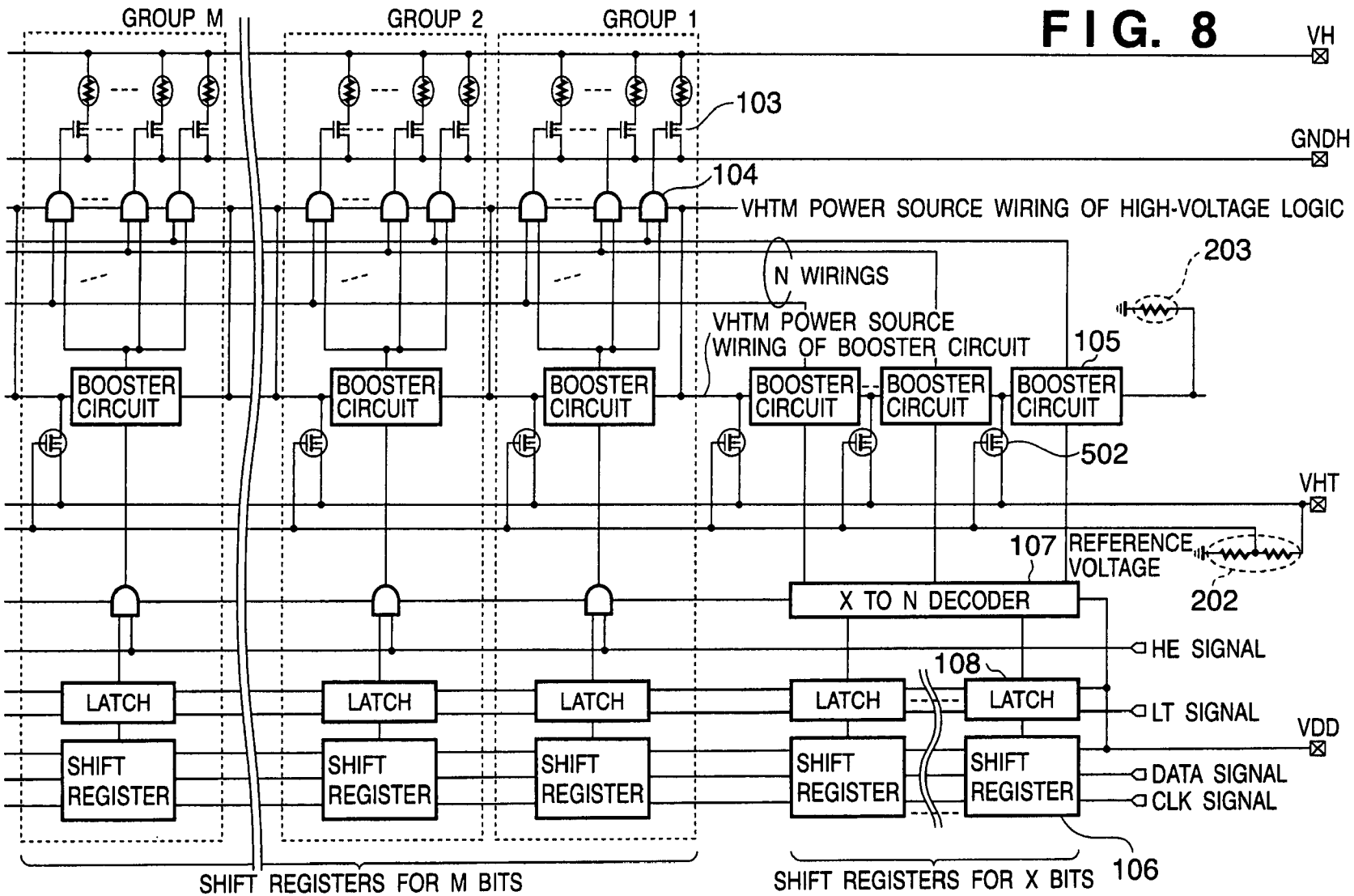
FIG. 8 is a block diagram schematically showing circuits arranged on the element body of FIG. 7.

FIG. 7 shows the layout of circuit blocks on an element body according to the second embodiment of the present invention. FIG. 8 is a circuit diagram showing blocks arranged on one side of an ink supply aperture on the element body of FIG. 7.

In the prior art and the first embodiment, the voltage of data which is output from the shift register and whose logic is finalized by the logic circuit 104 is boosted by the booster circuit 105 to a voltage (i.e., the converted voltage VHTM) capable of driving the driver transistor 103. To the contrary, in the second embodiment, the voltage of a data signal is boosted before the logic is finalized by a logic circuit 104.

More specifically, a signal which is output from the shift register and latch to select a group is boosted to the converted voltage VHTM by a booster circuit 105. By using the boosted data signal, the logic is finalized by the logic circuit 104 which operates at high voltage. The output from the logic circuit 104 is directly used to drive a driver transistor 103. This configuration can decrease the number of booster circuits 105 that is equal to the number of heaters in the prior art, and can further downsize the element body.

Similar to the first embodiment, the voltage converter circuit is divided into resistor sections 501 which are made up of resistive elements such as the dividing resistor of a reference voltage generating section 202 and a source load resistance 203, and MOSFET sections 502 which are divided in correspondence with respective heater groups to reduce one MOSFET size. The resistor section 501 is arranged at the same position as a position where the voltage converter circuit 110 is arranged in FIG. 1. To the contrary, the MOSFET sections 502 are distributedly interposed between the booster circuits 105 for respective heater groups.

In the first embodiment, the converted voltage VHTM is applied to the booster circuit 105. In the second embodiment, as shown in FIG. 8, the converted voltage VHTM is applied to the booster circuit 105 and the logic circuit 104 which operates at a high voltage. Thus, as shown in FIG. 7, the driver transistor 103, logic circuit 104, booster circuit 105, and MOSFET section 502 are arranged in the order named from a heater array 102 toward the outside of the element body.

In the second embodiment, as shown in FIG. 8, shift registers 106, decoders 107, and latches 108 are classified into shift registers, latches, and a decoder 107 which correspond to X bits, and shift registers and latches which correspond to M bits. The shift registers and latches for M bits are divided bit by bit for respective groups. As shown in FIG. 7, the shift registers 106, decoders 107, and latches 108 are arranged at each portion extending parallel to the heater array 102 outside the booster circuit 105 along the long side of the element body, instead of each portion where the resistor section 501 of the voltage converter circuit is arranged along the short side of the element body.

This arrangement can eliminate the data line and decoder line wiring area 111 which occupies a relatively large area of the element body at an outer portion along the long side in the prior art of FIG. 1 and the first embodiment of FIG. 5. As a result, the size of the short side of the element body can be reduced. In addition, the wiring lengths of the shift register, decoder, and latch can be shortened to implement a high-reliability circuit with high noise resistance.

This configuration is effective even when the number of nozzles increases to increase that of groups. In this case, only the length of the long side of the element body is increased without changing the length of the short side of each group.

Third Embodiment

Figure 9:
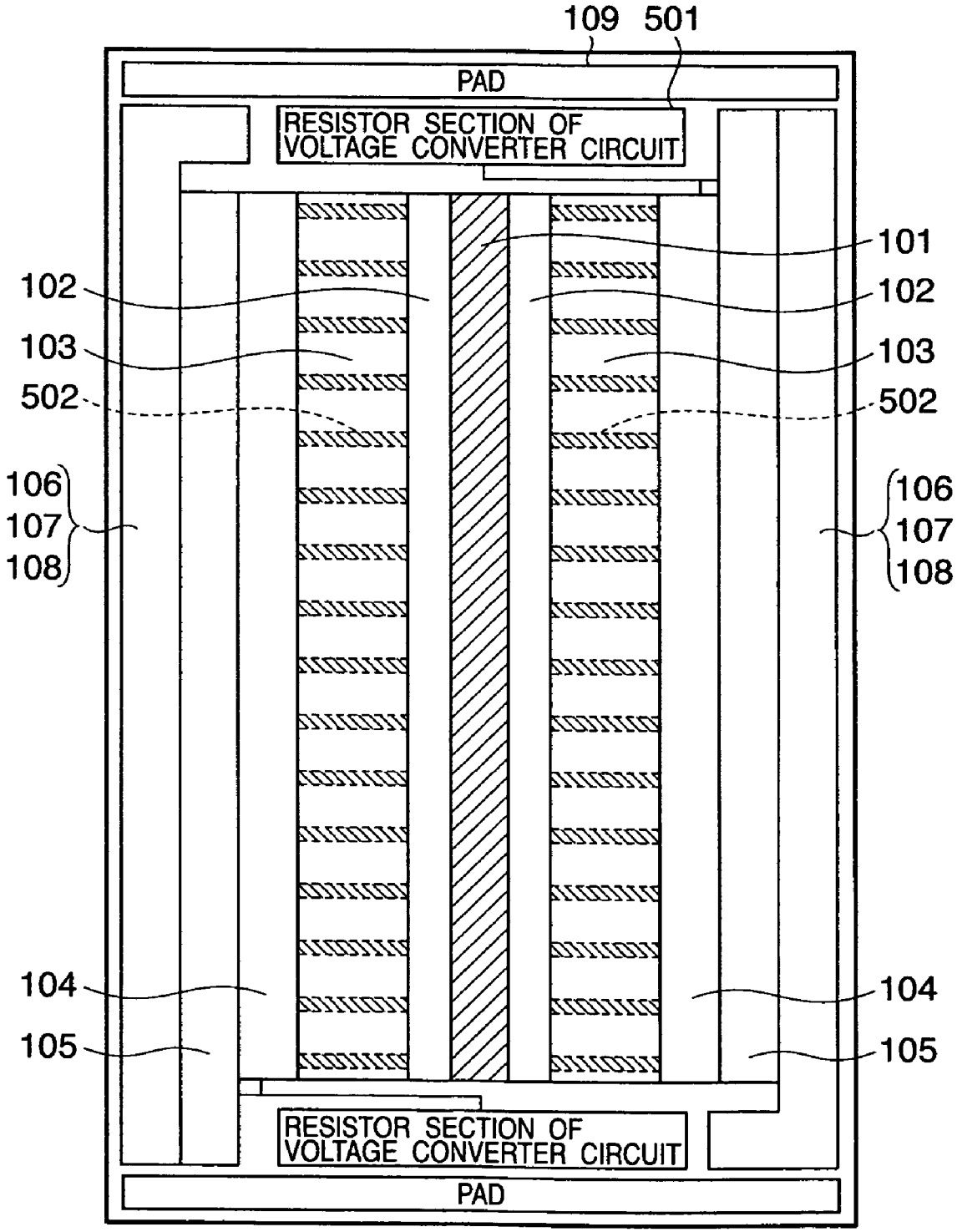
FIG. 9 is a view showing the circuit block layout of an element body according to the third embodiment.
Figure 10:
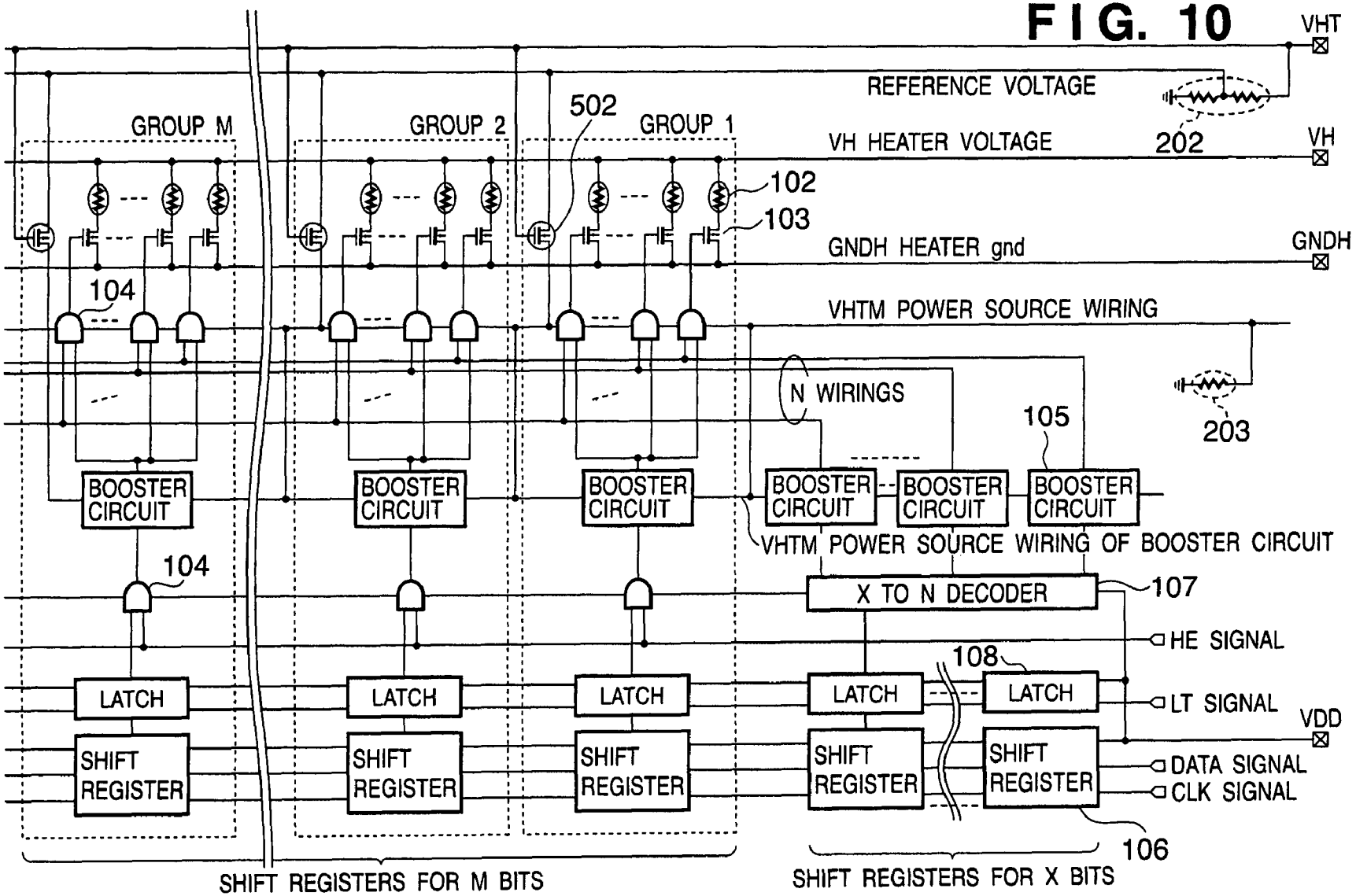
FIG. 10 is a block diagram schematically showing circuits arranged on the element body of FIG. 9.

FIG. 9 is a view showing the layout of circuit blocks on an element body according to the third embodiment of the present invention. FIG. 10 is a circuit diagram showing blocks arranged on one side of an ink supply aperture on the element body of FIG. 9.

The third embodiment changes the position of the MOSFET section in the second embodiment. In the second embodiment, the MOSFET sections 502 of the voltage converter circuit are distributedly interposed between the booster circuits 105. In the third-embodiment, MOSFET sections 502 are distributedly interposed between driver transistors 103.

This is because the driver transistor 103 has a large gate capacitance and requires a larger current consumption than those of a booster circuit 105 and a logic circuit 104 which operates at a high voltage. By arranging the MOSFET near the driver transistor 103, the converted voltage VHTM further stabilizes.

In the third embodiment, as shown in FIGS. 8 and 9, the MOSFET sections 502 of the voltage converter circuit are interposed between groups of the driver transistors 103. More specifically, as shown in FIG. 8, the MOSFET section 502 of the voltage converter circuit is arranged at a portion closer to the gate input portion of the driver transistor 103, and a stable voltage can be applied to the driver transistor 103 which receives a larger current.

Also in the third embodiment, the converted voltage VHTM generated by the MOSFET 502 is applied to the booster circuit 105 and to the logic circuit 104 which drives the driver transistor 103.

Note that an example of interposing the MOSFET 502 of the voltage converter circuit between the driver transistors 103 has been described. The same effects can also be obtained by interposing the MOSFET 502 between the logic circuits 104 which are arranged near the driver transistors 103 and operate at a high voltage.

Fourth Embodiment

Figure 11:
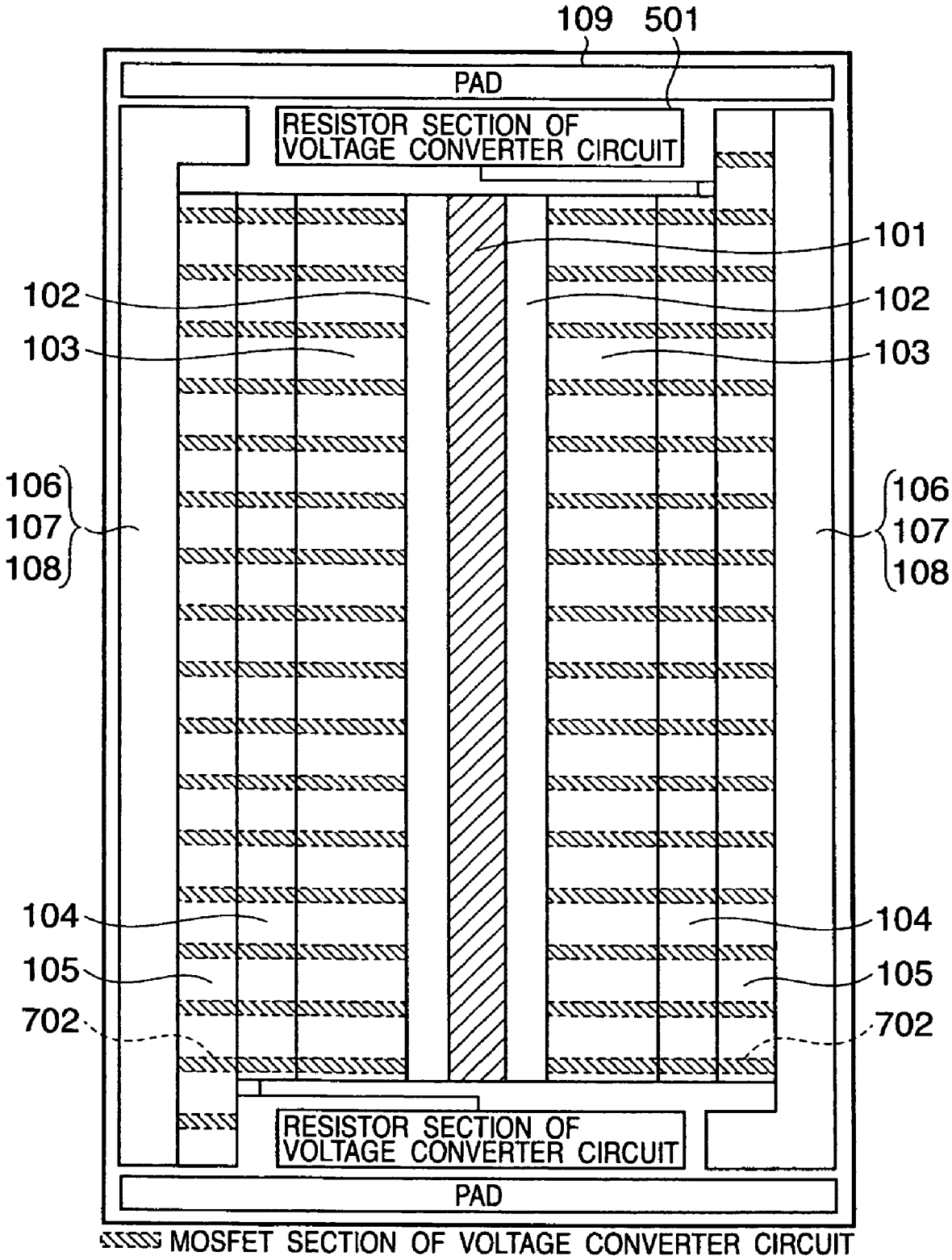
FIG. 11 is a view showing the circuit block layout of an element body according to the fourth embodiment.

FIG. 11 is a view showing the layout of circuit blocks on an element body according to the fourth embodiment of the present invention.

In the fourth embodiment, a plurality of MOSFET sections of the voltage converter circuit are arranged in each group in correspondence with respective circuit blocks which receive the converted voltage VHTM. In the second and third embodiments, the MOSFET section of the voltage converter circuit is arranged near one of the three circuit blocks: circuit blocks (logic circuit 104 and booster circuit 105) which receive the converted voltage VHTM, and the driver transistor. In the fourth embodiment, as shown in FIG. 11, MOSFET sections 702 of the voltage converter circuit are arranged near the three circuit blocks.

Since the converted voltage VHTM to be applied to each circuit block is generated by the MOSFET section 702 arranged near the circuit block, a stable voltage can be applied to all circuit blocks driven by the converted voltage VHTM.

In this case, if the size of each MOSFET is determined in accordance with power consumption of a corresponding circuit block, a stable design can be implemented with high area efficiency.

Fifth Embodiment

In the second to fourth embodiments, the shift register 106, decoder 107, and latch 108 are arranged along the heater array outside the booster circuit 105 on the long side of the element body. The MOSFET sections of the voltage converter circuit are distributedly arranged along the heater array near one or all of the driver transistor, high-voltage logic circuit, and booster circuit, and stably apply the converted voltage VHTM. At the same time, these circuit arrangements greatly reduce the layout area of the element body.

Figure 12:
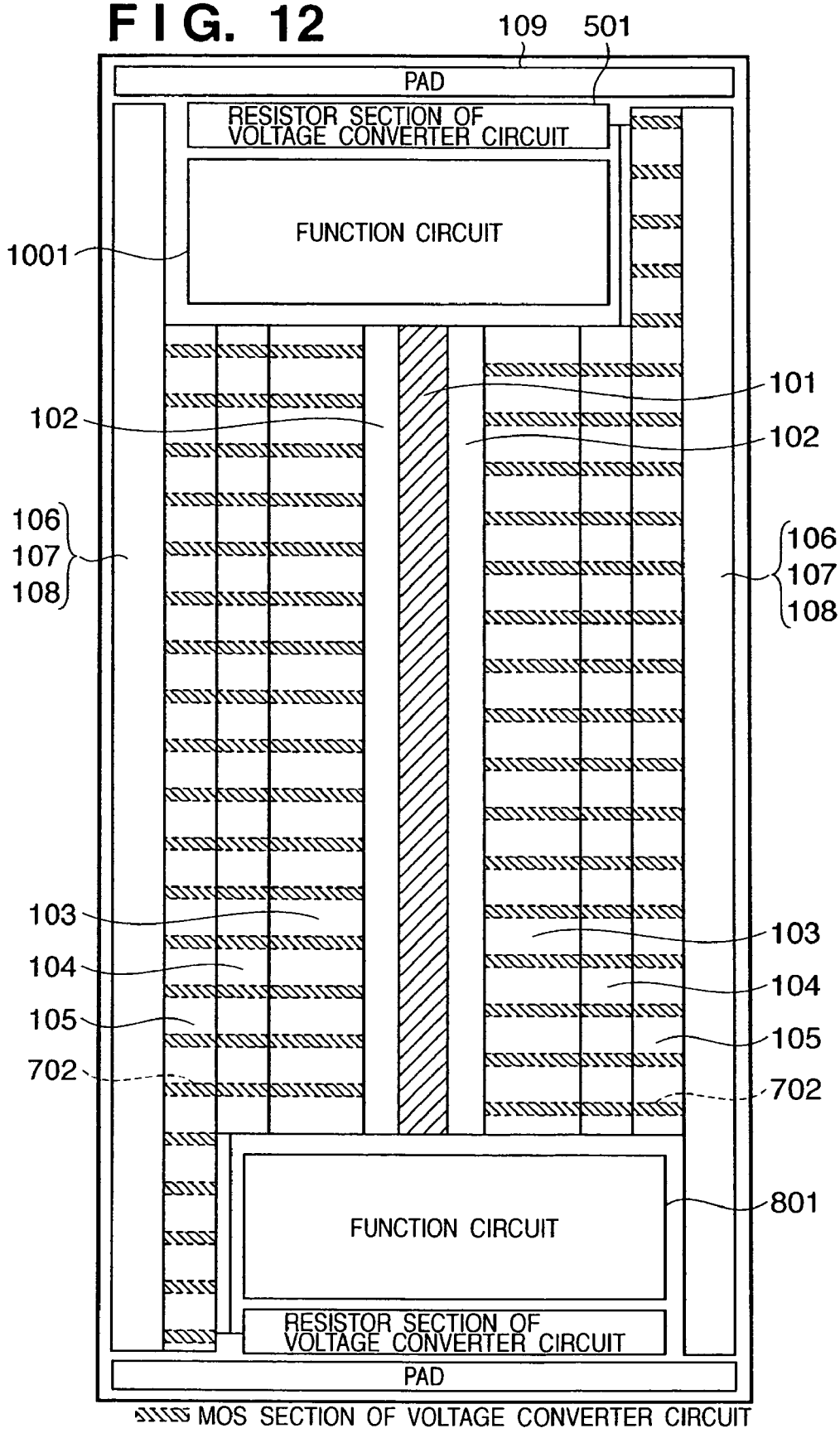
FIG. 12 is a view showing the circuit block layout of an element body according to the fifth embodiment.

In the fifth embodiment, function circuits 801 and 1001 are arranged in spaces at both ends of the body where the voltage converter circuit, shift register, latch, decoder, and the like are arranged as i shown in FIG. 1 in the prior art (FIG. 12). Examples of the arranged function circuit are those as described in Japanese Patent Laid-Open Nos. 2001-130002 and 2004-181679. Such a function circuit is suitably arranged near the two ends of the element body in the longitudinal direction, and is effectively applied to a configuration capable of greatly reducing the area where the voltage converter circuit is arranged in the prior art.

When the converted voltage VHTM needs to be applied to even the function circuit, a voltage converter section or MOSFET is individually arranged for the function circuit. This can minimize the influence of fluctuations in the converted voltage VHTM in the function circuit on another circuit, effectively stabilizing the converted voltage VHTM.

(Modification 1)

The MOSFET is used as the voltage converter element of the voltage converter circuit in the above-described embodiments, but a bipolar transistor may be used instead of the MOSFET. In this case, all the MOSFET sections in the embodiments are replaced with bipolar transistors.

A diode may be used as the voltage converter element of the voltage converter circuit instead of the MOSFET. Also in this case, all the MOSFET sections in the embodiments are replaced with diodes.

(Modification 2)

In the third to fifth-embodiments, the configurations and arrangements of the shift register, latch, and decoder are identical to those in the second embodiment. However, even if the configurations and arrangements in the prior art and the first embodiment are employed, the same effects can be obtained by arranging the MOSFET sections of the voltage converter circuit between or near driver transistor groups.

(Modification 3)

In the second to fifth embodiments, shift registers and latches for M bits are divided bit by bit for respective groups. However, the division number of the M-bit shift registers and latches need not be equal to the number (time division number: N) of heaters in each group.

For example, a shift register and latch circuit are arranged at once for two groups, and the division number of the M-bit shift registers and latches may be set to half of the time division number N.

The division number of the shift registers and latches is properly selected to decrease the area of the entire element body in accordance with the time division number N, the group number M, the heater density, the number of heaters, and the layout area ratio of the shift registers and decoders.

Other Embodiment

The features of the above-described embodiments and modifications may be selectively combined in accordance with a desired number of nozzles, the circuit configuration, a desired characteristic, or the like.

Figure 18:
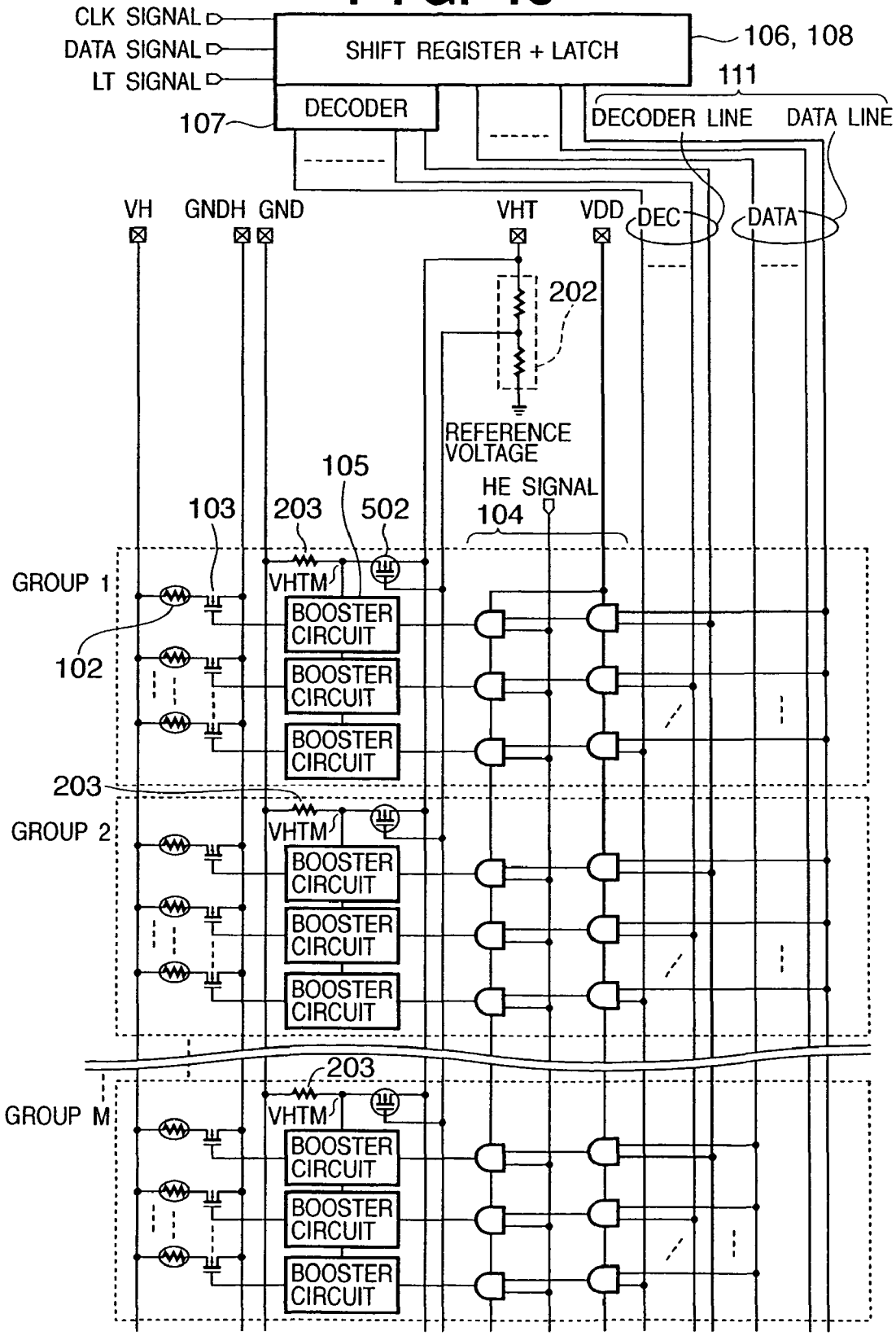
FIG. 18 is a block diagram schematically showing a circuit in which source loads are distributedly arranged according to another embodiment.

For example, FIG. 18 shows an example in which source load portions of the voltage converter circuit in FIG. 2 are distributedly arranged in respective groups, similar to the voltage converter sections. The source load is used in an area between the source of the MOSFET and GND where a current flowing from the source is suppressed to stabilize the voltage VHTM. Even when the voltage converter section is formed from a bipolar transistor or diode, the same effects can be obtained by interposing a load between the transistor and GND.

In the embodiment, a plurality of resistor sections 203 are arranged as source loads. The source load resistor sections 203 are distributedly arranged in respective recording element groups. This form can implement a circuit configuration which is hardly influenced by a voltage drop even when the number of simultaneously driven recording elements varies in all groups. In addition, unwanted voltage drops or the like caused by the wiring length can be suppressed to provide a stable voltage converter circuit.

The above-described embodiments have exemplified a so-called BUBBLE-JET® type inkjet recording head which abruptly heats and gasifies ink by using a heat element (heater) as a recording element and discharges ink droplets from an orifice by the pressure of generated bubbles. However, it is apparent that the present invention can be applied to a recording head which performs recording by another method as long as the recording head has a recording element array of recording elements.

In this case, the heater in the-embodiments is replaced with a recording element used in each method.

The above-described embodiments adopt, among inkjet recording methods, a method in which a means (e.g., an electric-to-thermal conversion device) for generating thermal energy as energy used to discharge ink is adopted and the ink state is changed by thermal energy. This inkjet recording method can increase the recording density and resolution.

Note that the present invention can be applied not only to the recording head and the element body for the recording head described in the embodiments, but also to a recording head cartridge having the recording head and an ink tank for holding ink to be supplied to the recording head. The present invention can also be applied to an apparatus (e.g., a printer, copying machine, or facsimile apparatus) which is equipped with the above-mentioned recording head and has a control means for supplying recording data to the recording head, and a system comprised of a plurality of devices (e.g., a host computer, interface device, reader, and printer) including the above-mentioned apparatus.

A recording apparatus having the above-described recording head, the mechanical structure of the recording head, and a recording head cartridge will be exemplified with reference to the accompanying drawings.

<Description of Inkjet Recording Apparatus>

Figure 13:
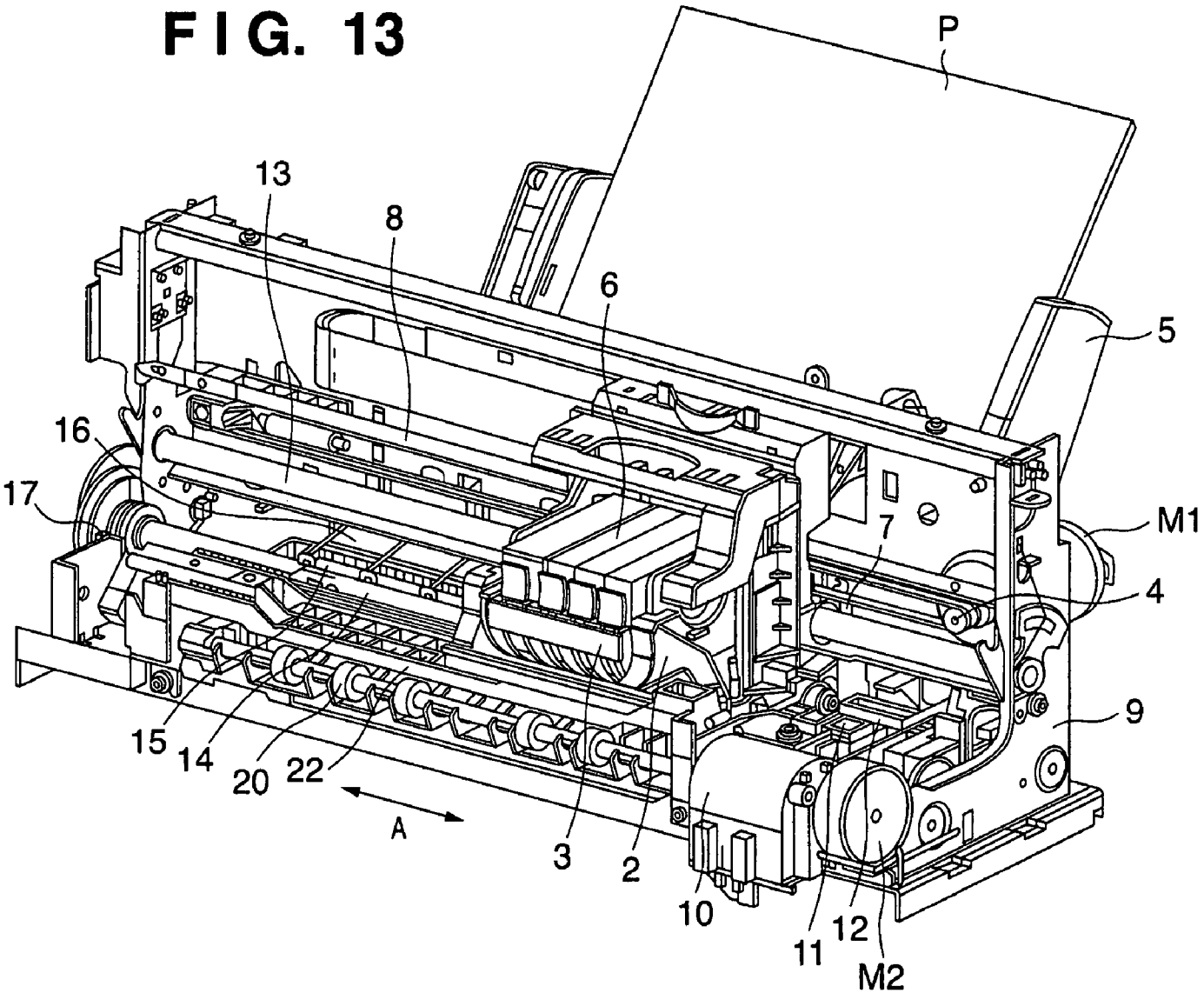
FIG. 13 is an outer perspective view showing the schematic structure of an inkjet recording apparatus which performs recording with a recording head according to the present invention.

FIG. 13 is an outer perspective view showing the schematic structure of an inkjet recording apparatus which performs recording with the recording head according to the present invention.

As shown in FIG. 13, in the inkjet recording apparatus (to be referred to as a recording apparatus hereinafter), a transfer mechanism 4 transfers a driving force generated by a carriage motor M1 to a carriage 2 which supports a recording head 3 for discharging ink to perform recording by the inkjet method. The carriage 2 reciprocates in a direction indicated by an arrow A. A recording medium P such as recording paper is supplied via a paper supply mechanism 5, and fed to a recording position. At the recording position, the recording head 3 discharges ink to the recording medium P to record information.

In order to maintain the recording head 3 in a good state, the carriage 2 is moved to the position of a recovery apparatus 10, and a discharge recovery process for the recording head 3 is executed intermittently.

The carriage 2 of the recording apparatus supports not only the recording head 3, but also an ink cartridge 6 which stores ink to be supplied to the recording head 3. The ink cartridge 6 is detachably mounted on the carriage 2.

The recording apparatus shown in FIG. 13 can perform color recording. For this purpose, the carriage 2 supports four ink cartridges which respectively store magenta (M), cyan (C), yellow (Y), and black (K) inks. The four ink cartridges are independently detachable.

The carriage 2 and recording head 3 can achieve and maintain a predetermined electrical connection by properly bringing their contact surfaces into contact with each other. The recording head 3 selectively discharges ink from a plurality of discharge apertures and records information by applying energy in accordance with the recording signal. In particular, the recording head 3 according to the embodiment adopts an inkjet recording method of discharging ink by using thermal energy, and comprises an electric-to-thermal conversion device in order to generate thermal energy. Electric energy applied to the electric-to-thermal conversion device is converted into thermal energy. Ink is discharged from discharge apertures by using a pressure change caused by the growth and contraction of bubbles after bubbles are generated by film boiling caused by applying the thermal energy to ink. The electric-to-thermal conversion device is arranged in correspondence with each discharge aperture, and ink is discharged from a corresponding discharge aperture by applying a pulse voltage to a corresponding electric-to-thermal conversion device in accordance with the recording signal.

As shown in FIG. 13, the carriage 2 is coupled to part of a driving belt 7 of the transfer mechanism 4 which transfers the driving force of the carriage motor MI. The carriage 2 is slidably guided and supported along a guide shaft 13 in the direction indicated by the arrow A. The carriage 2 reciprocates along the guide shaft 13 by normal rotation and reverse rotation of the carriage motor M1. A scale 8 which represents the absolute position of the carriage 2 is arranged along the moving direction (direction indicated by the arrow A) of the carriage 2. In the embodiment, the scale 8 is prepared by printing black bars on a transparent PET film at a necessary pitch. One end of the scale 8 is fixed to a chassis 9, and the other end is supported by a leaf spring (not shown).

The recording apparatus has a platen (not shown) opposing the discharge aperture surface having the discharge apertures (not shown) of the recording head 3. Simultaneously when the carriage 2 supporting the recording head 3 reciprocates by the driving force of the carriage motor M1, a recording signal is supplied to the recording head 3 to discharge ink and record information on the entire width of the recording medium P fed onto the platen.

In FIG. 13, reference numeral 14 denotes a feed roller which is driven by a feed motor M2 in order to feed the recording medium P; 15, a pinch roller which makes the recording medium P abut against the feed roller 14 by a spring (not shown); 16, a pinch roller holder which rotatably supports the pinch roller 15; and 17, a feed roller gear which is fixed to one end of the feed roller 14. The feed roller 14 is driven by rotation of the feed motor M2 that is transferred to the feed roller gear 17 via an intermediate gear (not shown).

Reference numeral 20 denotes a discharge roller which discharges the recording medium P bearing an image formed by the recording head 3 outside the recording apparatus. The discharge roller 20 is driven by transferring rotation of the feed motor M2. The discharge roller 20 abuts against a spur roller (not shown) which presses the recording medium P by a spring (not shown). Reference numeral 22 denotes a spur holder which rotatably supports the spur roller.

As shown in FIG. 13, in the recording apparatus, the recovery apparatus 10 which recovers the recording head 3 from a discharge failure is arranged at a desired position (e.g., a position corresponding to the home position) outside the reciprocation range (outside the recording area) for the recording operation of the carriage 2 supporting the recording head 3.

The recovery apparatus 10 comprises a capping mechanism 11 which caps the discharge aperture surface of the recording head 3, and a wiping mechanism 12 which cleans the discharge aperture surface of the recording head 3. The recovery apparatus 10 performs a discharge recovery process in which a suction means (suction pump or the like) within the recovery apparatus 10 forcibly discharges ink from discharge apertures in synchronism with capping of the discharge aperture surface by the capping mechanism 11, thereby removing ink with a high viscosity or bubbles in the ink flow path of the recording head 3.

In a non-recording operation or the like, the discharge aperture surface of the recording head 3 is capped by the capping mechanism 11 to protect the recording head 3 and prevent evaporation and drying of ink. The wiping mechanism 12 is arranged near the capping mechanism 11, and wipes ink droplets attached to the discharge aperture surface of the recording head 3.

The capping mechanism 11 and wiping mechanism 12 can maintain the recording head 3 in a normal ink discharge state.

<Control Configuration of Inkjet Recording Apparatus>

Figure 14:
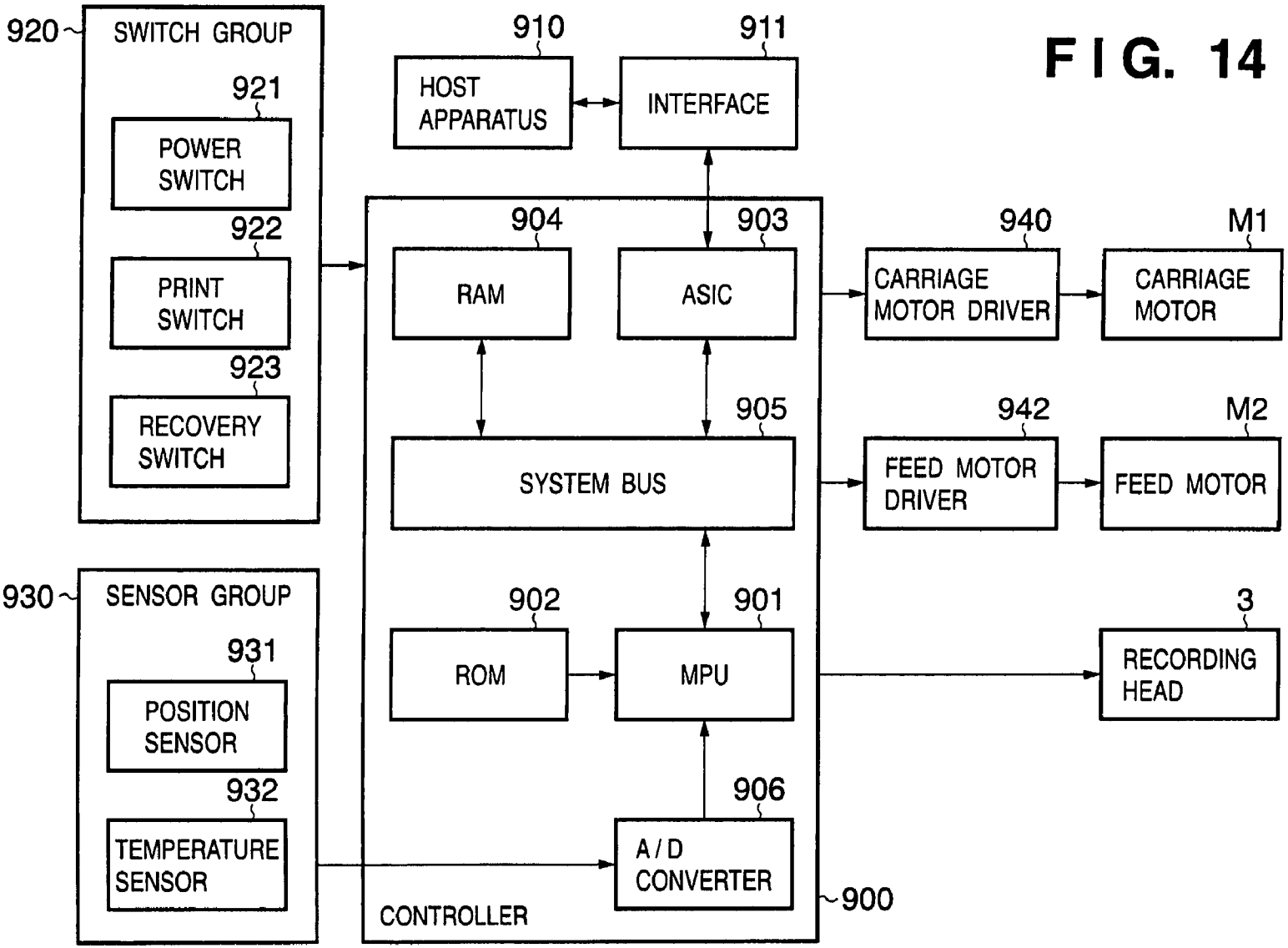
FIG. 14 is a block diagram showing the control configuration of the recording apparatus shown in FIG. 13.

FIG. 14 is a block diagram showing the control configuration of the recording apparatus shown in FIG. 13.

As shown in FIG. 14, a controller 900 comprises an MPU 901, and a ROM 902 which stores a program corresponding to a control sequence (to be described later), a predetermined table, and other permanent data. The controller 900 also comprises an ASIC (Application Specific Integrated Circuit) 903 which generates control signals for controlling the carriage motor M1, feed motor M2, and recording head 3, and a RAM 904 having a recording data rendering area, a work area for executing a program, and the like. The controller 900 further comprises a system bus 905 which connects the MPU 901, ASIC 903, and RAM 904 to each other and exchanges data, and an A/D converter 906 which receives analog signals from a sensor group (to be described below), A/D-converts them, and supplies digital signals to the MPU 901.

In FIG. 14, reference numeral 910 denotes a host apparatus such as a computer (or an image reader, digital camera, or the like) serving as a recording data supply source. The host apparatus 910 and recording apparatus transmit/receive recording data, commands, status signals, and the like via an interface (I/F) 911.

Reference numeral 920 denotes a switch group which is formed from switches for receiving instruction inputs from the operator, such as a power switch 921, a print switch 922 for designating the start of printing, and a recovery switch 923 for designating the activation of a process (recovery process) to maintain good ink discharge performance of the recording head 3. Reference numeral 930 denotes a sensor group which detects the state of the apparatus and includes a position sensor 931 such as a photocoupler for detecting a home position h and a temperature sensor 932 arranged at a proper portion of the recording apparatus in order to detect the ambient temperature.

Reference numeral 940 denotes a carriage motor driver which drives the carriage motor M1 for reciprocating-the carriage 2 in the direction indicated by the arrow A; and 942, a feed motor driver which drives the feed motor M2 for feeding the recording medium P.

In recording and scanning by the recording head 3, the ASIC 903 transfers driving data (DATA) for a recording element (discharge heater) to the recording head 3 while directly accessing the storage area of the ROM 902.

<Recording Head Structure>

Figure 15:
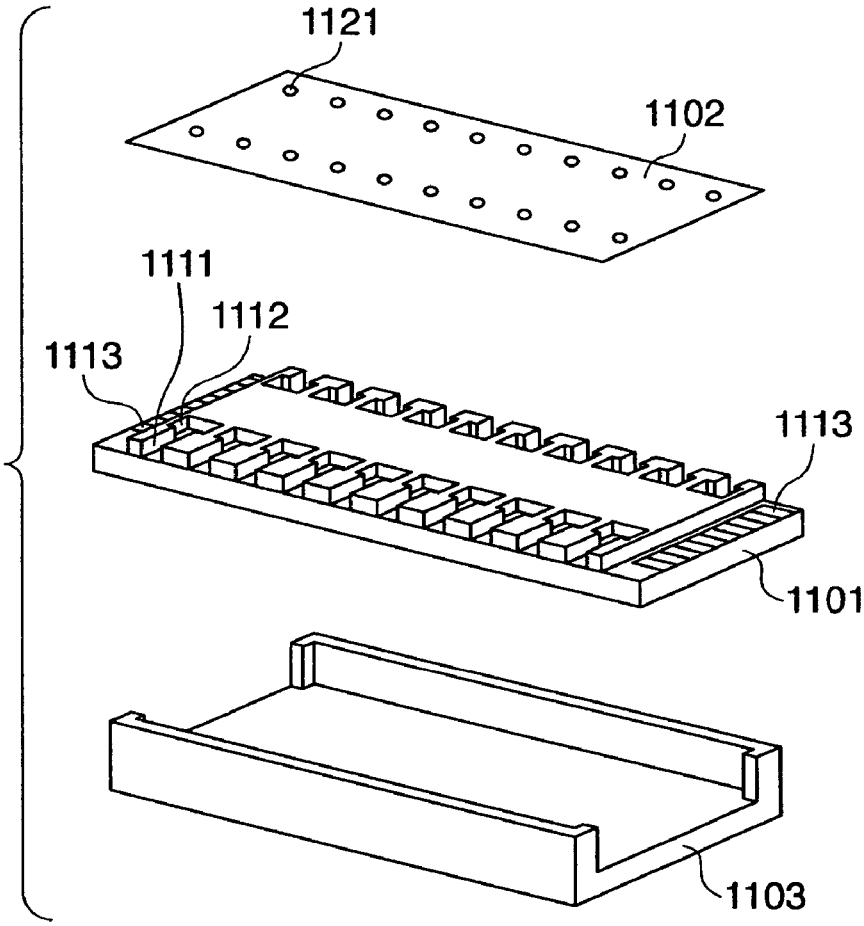
FIG. 15 is an exploded perspective view showing the mechanical structure of an inkjet recording head used in the recording apparatus of FIG. 13.

FIG. 15 is an exploded perspective view showing the mechanical structure of the recording head 3 used in the above-described recording apparatus.

In FIG. 15, reference numeral 1101 denotes an element body prepared by integrating a circuit configuration (to be described later) into a substrate of silicon or the like. On the element body, heat resistors 1112 are formed as electric-to-thermal conversion elements which form recording elements. Flow paths 1111 are formed around the resistors 1112 toward the two sides of the body. A member which forms the flow paths can be made of a resin (e.g., dry film), SiN, or the like.

In FIG. 15, reference numeral 1102 denotes an orifice plate which has a plurality of discharge apertures 1121 in correspondence with positions at which they face the heat resistors 1112. The orifice plate 1102 is joined to the member which forms the flow paths.

In FIG. 15, reference numeral 1103 denotes a wall member which forms a common ink chamber for supplying ink. Ink is supplied from the common ink chamber to the flow paths so as to flow at the periphery of the element body 1101.

Connection terminals 1113 for receiving data and signals from the recording apparatus main body are formed on the two sides of the element body 1101.

<Recording Head Cartridge>

The present invention can also be applied to a recording head cartridge having the above-described recording head and an ink tank for holding ink to be supplied to the recording head. The form of the recording head cartridge may be a structure integrated with the ink tank or a structure separable from the ink tank.

Figure 16:
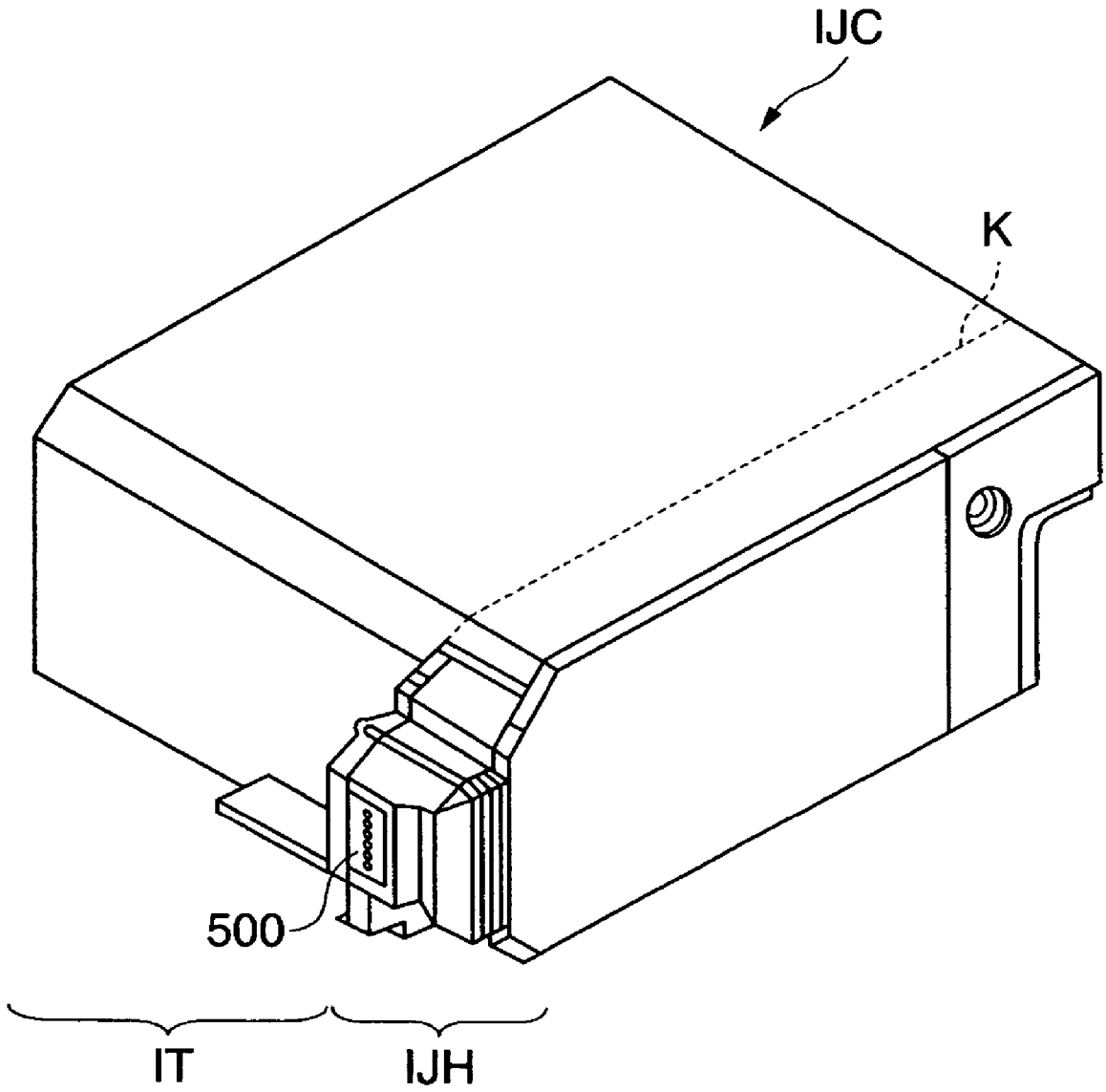
FIG. 16 is an outer perspective view showing the structure of a recording head cartridge obtained by integrating an ink tank and recording head.

FIG. 16 is an outer perspective view showing the structure of a recording head cartridge IJC obtained by integrating an ink tank and recording head. Inside the head cartridge IJC, an ink tank IT and recording head IJH are separated at the position of a boundary K shown in FIG. 16, but cannot be individually replaced. The head cartridge IJC has an electrode (not shown) for receiving an electrical signal supplied from a carriage HC when the head cartridge IJC is mounted on the carriage HC. This electrical signal drives the recording head IJH to discharge ink, as described above.

The head cartridge may be so configured as to fill or refill ink in the ink tank.

In FIG. 16, reference numeral 500 denotes an ink discharge aperture array having a black nozzle array and color nozzle array. The ink tank IT is equipped with a fibrous or porous ink absorber in order to hold ink.

Figure 17:
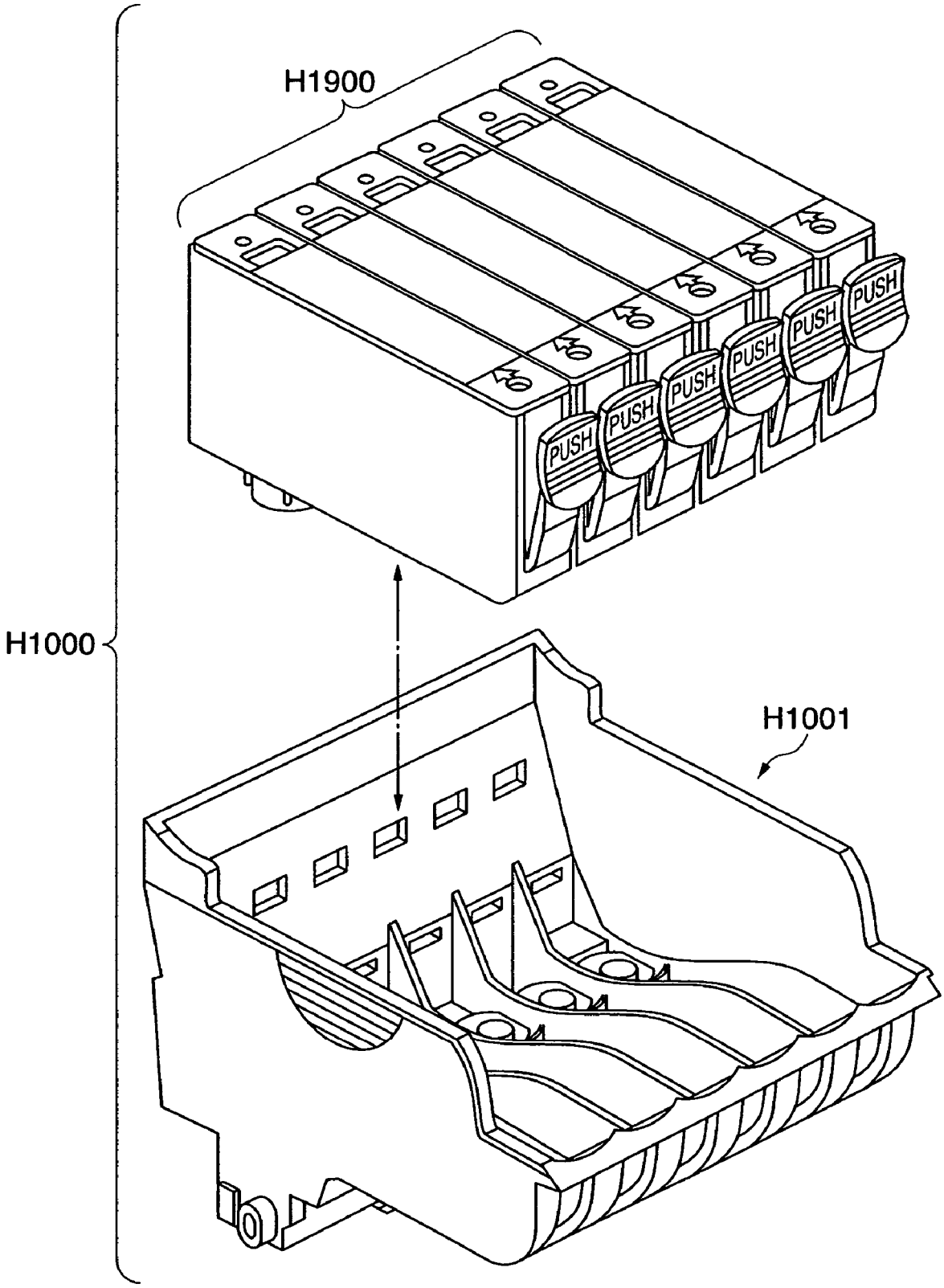
FIG. 17 is an outer perspective view showing the structure of a recording head cartridge in which an ink tank and recording head are separable.

FIG. 17 is an outer perspective view showing the structure of a recording head cartridge in which an ink tank and recording head are separable. A recording head cartridge H1000 comprises an ink tank H1900 which stores ink, and a recording head H1001 which discharges, from a nozzle, ink supplied from the ink tank H1900 in accordance with recording information. The recording head cartridge H1000 adopts a so-called cartridge system in which the recording head cartridge H1000 is detachably mounted on the carriage.

The recording head cartridge H1000 shown in FIG. 17 implements photograph-like high-quality color recording. For this purpose, independent ink tanks for black, light cyan, light magenta, cyan, magenta, and yellow are prepared as ink tanks. As shown in FIG. 17, these ink tanks are freely detachable from the recording head H1001.

As many apparently widely different embodiments of the present invention can be made without departing from the spirit and scope thereof, it is to be understood that the invention is not limited to the specific embodiments thereof except as defined in the claims.

This application claims the benefit of Japanese Application No. 2005-176890, filed Jun. 16, 2005, which is hereby incorporated by reference herein in its entirety.

What is claimed is:

1. An element body for a recording head, comprising:

a plurality of recording elements which are divided into a plurality of groups including a first group and a second group, each group including driver transistors which respectively drive said recording elements, logic circuits which select said recording elements to be driven on the basis of image data, and booster circuits which boost a voltage of signals output from said logic circuits and apply the boosted voltage to said driver transistors; and a voltage converter circuit which converts an externally input voltage, wherein said voltage converter circuit includes a reference voltage generating section and a voltage converter section, and said voltage converter section includes a first voltage converter element and a second voltage converter element, said first voltage converter element being arranged in said first group and said second voltage converter element being arranged in said second group.

2. The element body according to claim 1, wherein said voltage converter circuit generates, as at least a power source voltage of said booster circuits, an interlevel voltage having a potential between a drive voltage of said recording elements and a power source voltage of said logic circuits.

3. The element body according to claim 1, wherein an array direction of said plurality of recording elements comprises a longitudinal direction of an elongated ink supply aperture which is formed in the element body in order to supply ink, and in each group, said recording elements, said driver transistors, and said logic circuits are arranged in an order named from the ink supply aperture in a direction transverse to the array direction.

4. The element body according to claim 1, wherein said reference voltage generating section extends in a direction perpendicular to an array direction of said plurality of recording elements.

5. The element body according to claim 1, wherein one voltage converter element is arranged in each of the plurality of groups of a predetermined number of adjacent recording elements.

6. The element body according to claim 1, wherein said booster circuits are arranged in correspondence with said plurality of recording elements, and interposed between said driver transistors and said logic circuits in a direction transverse to an array direction of said plurality of recording elements.

7. The element body according to claim 1, wherein said first and second voltage converter elements are distributedly arranged in an area where at least one of said driver transistors, said booster circuits, and said logic circuits is arranged.

8. The element body according to claim 1, wherein each of said first and second voltage converter elements comprises a MOSFET.

9. The element body according to claim 1, wherein said reference voltage generating section includes a resistor.

10. The element body according to claim 1, wherein said voltage converter circuit has a load between at least one of said first and second voltage converter elements and GND.

11. The element body according to claim 1, wherein each of said recording elements comprises a heater which applies thermal energy to ink.

12. A recording head comprising an element body defined in claim 1, wherein discharge apertures for discharging ink are formed in correspondence with respective recording elements.

13. A recording head cartridge comprising:

an element body defined in claim 1;

a recording head in which discharge apertures for discharging ink are formed in correspondence with respective recording elements; and an ink tank which holds ink in order to supply ink to said recording head.

14. The element body according to claim 2, wherein said logic circuits are driven by the interlevel voltage and operate at a high voltage, and said booster circuits are arranged in each group, and are arranged in an array direction of said plurality of recording elements outside said logic circuits which operate at the high voltage.

15. The element body according to claim 9, wherein the resistor is formed from polysilicon.

16. The element body according to claim 10, wherein a plurality of loads are arranged in correspondence with said first and second voltage converter elements.

17. The element body according to claim 10, wherein the load includes a resistor.

18. A recording apparatus comprising:

a recording head defined in claim 12; and control means for transmitting image data to said recording head.

* * * * *